US006407693B1

(12) United States Patent
Murase et al.

(10) Patent No.: US 6,407,693 B1
(45) Date of Patent: Jun. 18, 2002

(54) RADIO WAVE ABSORBENT ASSEMBLING MEMBER RADIO WAVE ABSORBENT AND METHOD FOR PRODUCING THE SAME

(75) Inventors: Taku Murase; Hiroshi Kurihara; Toshifumi Saitoh; Motonari Yanagawa, all of Tokyo; Kozo Hayashi; Kyoichi Fujimoto, both of Kakamigahara, all of (JP)

(73) Assignees: TDK Corporation, Tokyo; Tokiwa Electric Co., Kakamigahara, both of (JP)

( * ) Notice: Subject to any disclaimer, the term of this patent is extended or adjusted under 35 U.S.C. 154(b) by 0 days.

(21) Appl. No.: 09/487,613

(22) Filed: Jan. 20, 2000

(30) Foreign Application Priority Data

Jan. 21, 1999 (JP) ..... 11-013326

(51) Int. Cl.[7] ..... H01Q 17/00

(52) U.S. Cl. ..... 342/4; 342/1

(58) Field of Search ..... 342/1, 4

(56) References Cited

U.S. PATENT DOCUMENTS 5,952,953 A * 9/1999 Nikawa et al. ..... 342/1

FOREIGN PATENT DOCUMENTS

| | | |
|---|---|---|
| JP | 8-067544 | 3/1996 |
| JP | 8-512178 | 12/1996 |
| JP | 9-275295 | 10/1997 |
| JP | 9-307268 | 11/1997 |
| JP | 2760578 | 3/1998 |
| JP | 03035597 A | 3/1998 |
| JP | 10-163670 | 6/1998 |

* cited by examiner

*Primary Examiner*—Ian J. Lobo
(74) *Attorney, Agent, or Firm*—Oblon, Spivak, McClelland, Maier & Neustadt, P.C.

(57) ABSTRACT

The radio wave absorbent-assembling member comprises a radio wave absorptive thin material capable of assembling a structure in a desired form, wherein the thin material contains a conductive material therein and/or has on the surface thereof a conductive layer containing a conductive material, and a radio wave absorbent having a stereo-structure can be obtained by folding the above radio wave absorbent-assembling member and joining together the end portions of the thin material.

27 Claims, 26 Drawing Sheets

RADIO WAVE ABSORBENT ASSEMBLING MEMBER RADIO WAVE ABSORBENT AND METHOD FOR PRODUCING THE SAME

BACKGROUND OF THE INVENTION

The present invention relates to a radio wave absorbent for use in an anechoic chamber, a radio wave absorbent-assembling member which can be used in the radio wave absorbent, and a method for producing the radio wave absorbent.

Recently, the use of a radio wave has been rapidly extended, mainly in the mobile information field, toward realizing highly developed information society. Further, with the great progress of recent microelectronics technique, various electric apparatus have been spread. However, with such a progress of information communication technique, the influence of unnecessary electromagnetic noises exerted onto precision apparatus associated devices has posed problems.

For the measurements of electromagnetic noises, an anechoic chamber where there is no reflection of electromagnetic waves is generally used, and a radio wave absorbent is arranged in the inner wall of the anechoic chamber. As the conventional radio wave absorbent used in the anechoic chamber, there can be mentioned one that is composed of an organic material, such as a foamed polystyrol, a foamed polystyrene or a foamed polyurethane, which has incorporated thereinto carbon black or the like for obtaining a conductivity. In addition, the radio wave absorbent is used as a stereo-structure in the form of quadrangular pyramid, triangular prism or wedge. Such a radio wave absorbent as a stereo-structure is generally produced by, for example, a method in which particles of an organic material, such as polystyrol, polystyrene or polyurethane without foaming, are prefoamed into spheres having a diameter of several mm, and the surfaces of the spheres are coated with a conductive material powder, such as carbon black, followed by heating in a desired die, to thereby effect post-foaming.

Further, in recent years, there have been proposed a member for a radio wave absorbent which is a stereo-structure having a hollow inner portion, and the method for producing the radio wave absorbent (see Japanese Patent No. 2760578 and Japanese Patent Application Laid-Open Specification Nos. 67544/1996, 275295/1997, 307268/1997 and 163670/1998).

However, the radio wave absorbents in the form of quadrangular pyramid, triangular prism, wedge and the like produced by the method in which an organic material, such as polystyrol, polystyrene or polyurethane, is heat-foamed as mentioned above have problems in that not only is the carrying of the radio wave absorbent difficult during the construction of an anechoic chamber since the radio wave absorbent is bulky, but also the radio wave absorbent is damageable against contacting and the like.

Further, in the production method described in Japanese Patent No. 2760578, a treatment in which a predetermined portion for folding is locally heated and softened is needed. Therefore, a problem arises in that the operation is complicated. In addition, a thermoplastic synthetic resin is used in a radio wave absorbent in this method. Therefore, when such a radio wave absorbent is used in the anechoic chamber for a test using a large electric power, such as immunity test, the radio wave absorbent has problems from the viewpoint of safety because it has poor non-combustibility and poor fire resistance.

Further, in the member for a radio wave absorbent and the method for producing the same described in Japanese Patent Application Laid-Open Specification No. 67544/1996, a radio wave absorbent in which a lightweight mortar is used has been proposed. However, in this prior art technique, it is necessary to employ a plurality of treatment steps as well as a plurality of members. Therefore, a problem arises in that the operation is complicated. In addition, organic hollow particles and organic binders, which are used in large amounts and used for reducing the weight of the mortar, are semi-non-combustible materials. Therefore, there is a problem in that the smoking amount is extremely large, as compared with that expected in the case using a non-combustible material.

Further, the radio wave absorbent described in Japanese Patent Application Laid-Open Specification No. 275295/1997 has a problem of a very high production cost.

Further, in the radio wave absorbent described in Japanese Patent Application Laid-Open Specification No. 307268/1997, not only a molded material made of a ceramic fiber and a glass fiber but also a plurality of production steps are needed. Therefore, there is a problem in that the production cost is high.

Further, with respect to any of the above-mentioned conventional radio wave absorbents having a hollow stereo-structure, the weight reduction is not satisfactory. Therefore, there is a problem in that the workability is poor when the radio wave absorbent is installed in the sidewall and the inner wall of the ceiling of the anechoic chamber.

SUMMARY OF THE INVENTION

In view of the above, the present invention has been made, and an object of the present invention is to provide a radio wave absorbent which is advantageous not only in that the workability is excellent during the construction of an anechoic chamber, but also in that it has a non-combustibility and a desired form, a production method which is advantageous in that the above radio wave absorbent can be easily produced, and a radio wave absorbent-assembling member which can be used for the above radio wave absorbent.

For attaining the above object, the radio wave absorbent-assembling member of the present invention has a construction such that it comprises a radio wave absorptive thin material capable of assembling a structure in a desired form, wherein the thin material contains a conductive material therein and/or has on the surface thereof a conductive layer containing a conductive material.

The radio wave absorbent of the present invention is formed using a radio wave absorbent-assembling member and has a construction such that it is a structure formed by folding the radio wave absorbent-assembling member which comprises a radio wave absorptive thin material capable of assembling a structure in a desired form and joining together the end portions of the folded radio wave absorbent-assembling member, wherein the thin material contains a conductive material therein and/or has on the surface thereof a conductive layer containing a conductive material.

The method for producing a radio wave absorbent of the present invention comprises: processing a thin material into a form which is capable of assembling a structure in a desired form, to thereby prepare a radio wave absorbent-assembling member, wherein the thin material contains a conductive material therein and/or has on the surface thereof a conductive layer containing a conductive material; and folding the radio wave absorbent-assembling member and joining together the end portions of the folded radio wave absorbent-assembling member.

The present invention is advantageous not only in that it is possible to reduce both of the weight of a radio wave absorbent and the production cost thereof since the radio wave absorbent-assembling member is made of a radio wave absorptive thin material, but also in that the carrying or the like of the radio wave absorbent-assembling member is very easy during the construction of an anechoic chamber since the radio wave absorbent-assembling member is in a plane form and not bulky. Further, by the present invention, a radio wave absorbent can be produced simply by folding a radio wave absorbent-assembling member into a structure in a desired form without any pretreatment of the radio wave absorbent-assembling member. Therefore, the workability is extremely excellent, and the radio wave absorbent obtained by using a non-combustible paper as a thin material has a non-combustibility. In addition, when a frame member is fixed to a unit comprising a plurality of radio wave absorbents, the installation of the radio wave absorbents to the inner wall of an anechoic chamber can be performed unit by unit. Therefore, the workability during the construction of the anechoic chamber can be remarkably improved. Further, after installation of the radio wave absorbent of the present invention, the safety with respect to the accidents, such as contacting, is extremely excellent, and when the radio wave absorbent suffers a damage, an exchanging or repairing operation is easy since the cost for the radio wave absorbent is low and the workability including an installation is excellent as mentioned above. In addition, since a non-combustible paper is used as a thin material, it is possible to destroy the radio wave absorbent simply by folding compactly. Therefore, the workability is excellent, and the radio wave absorbent can also be recycled.

BEST MODE FOR CARRYING OUT THE INVENTION

Hereinbelow, the embodiment of the present invention will be described.

First embodiment

Figure 1:
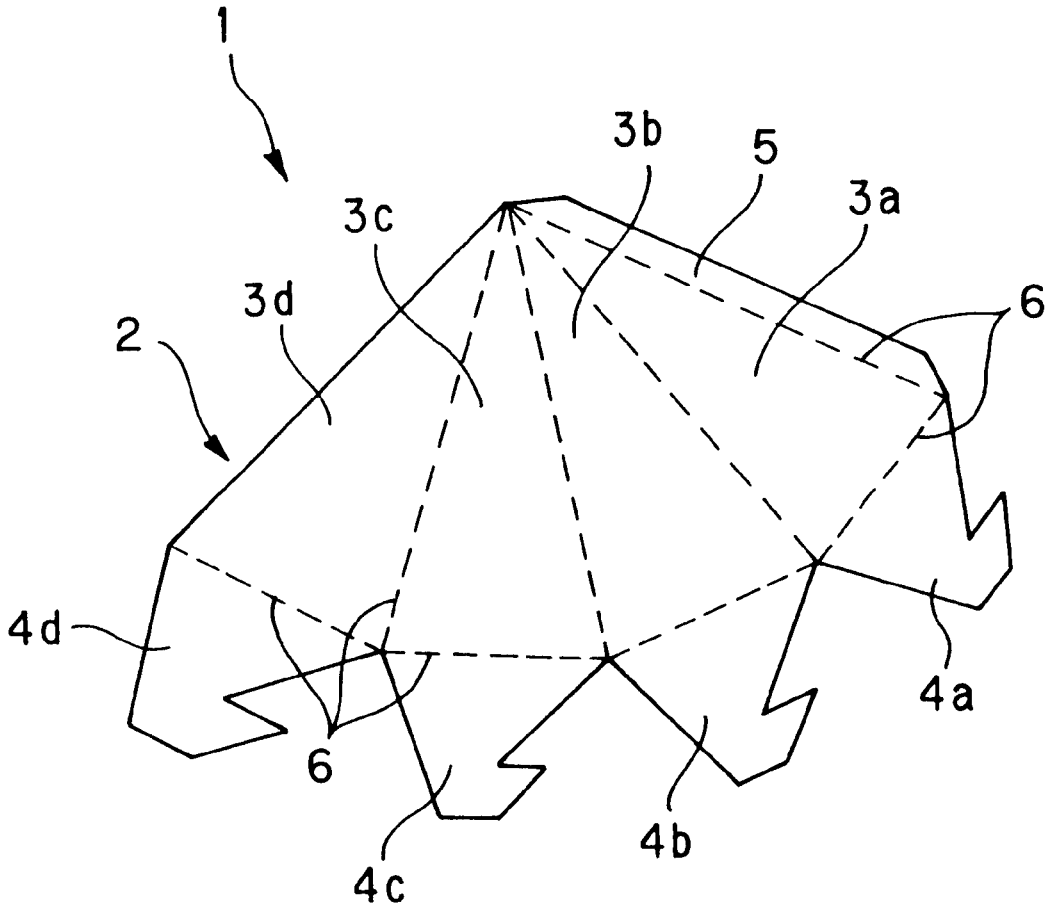
FIG. 1 is a plan view showing one embodiment of the radio wave absorbent-assembling member of the present invention.
Figure 2A:
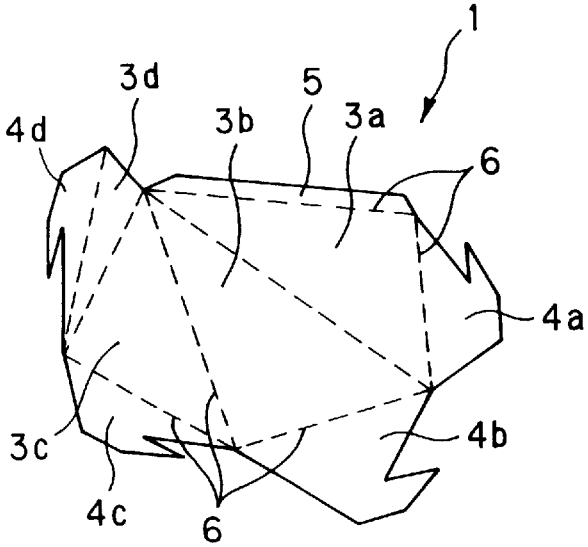
FIGS. 2A–2D are explanatory views illustrating the method for producing a radio wave absorbent using the radio wave absorbent-assembling member shown in FIG. 1 and the radio wave absorbent of the present invention.
Figure 2B:
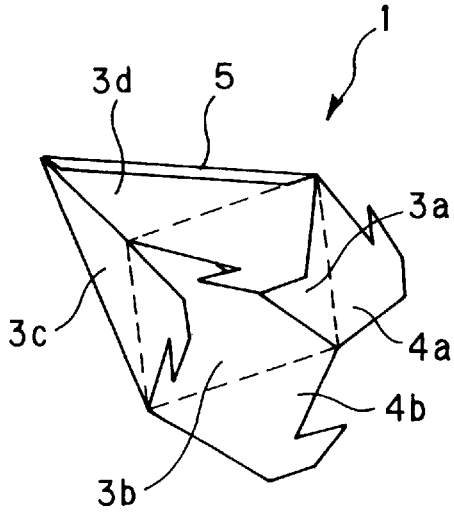
Figure 2C:
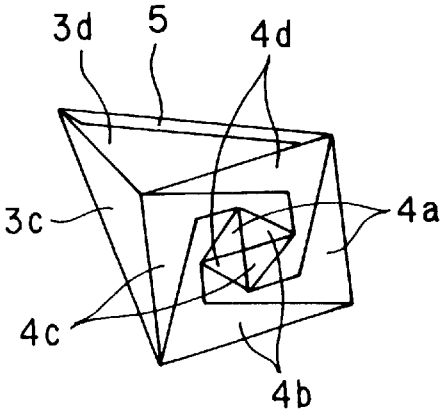
Figure 2D:
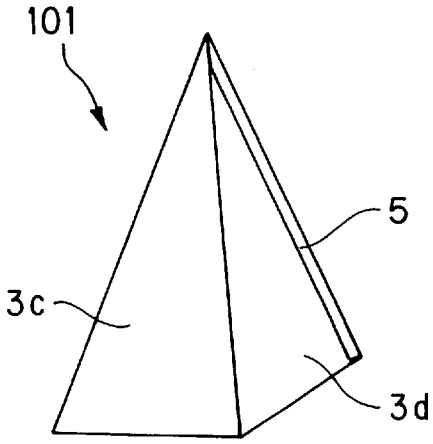

FIG. 1 is a plan view showing one embodiment of the radio wave absorbent-assembling member of the present invention. In FIG. 1, radio wave absorbent-assembling member 1 comprises a radio wave absorptive thin material 2 which is capable of assembling a structure in a desired form. In the example shown in this figure, thin material 2 is capable of assembling a structure in the form of quadrangular pyramid, and comprises side plane members 3*a*, 3*b*, 3*c* and 3*d* which constitute the side planes of the quadrangular pyramid form, base plane members 4*a*, 4*b*, 4*c* and 4*d* which constitute the base plane, and joining member 5. Further, thin material 2 has concave portions 6 (indicated by chain lines) for folding at the respective boundaries between the above-mentioned members. Each of the above-mentioned base plane members 4*a*, 4*b*, 4*c* and 4*d* has a form such that they are superposed on one another at the time of assembly to constitute the base plane.

The term "radio wave absorptive" used in the present invention means to have a reflectivity of about −20 dB or less.

In the present invention, thin material 2 which constitutes radio wave absorbent-assembling member 1 is any one of: (1) that which contains a conductive material therein; (2) that has on the surface thereof a conductive layer containing a conductive material; and (3) that which contains a conductive material therein and has on the surface thereof a conductive layer containing a conductive material. Specifically, as an example of item (1) above, there can be used a non-combustible paper made from a slurry which contains an anhydrous inorganic compound and a conductive material. In addition, the thin material having the conductive layer mentioned in item (2) above can be produced by, for example, a method in which a conductive material is dispersed in an inorganic binder, to thereby prepare a conductive coating liquid, and in the prepared conductive coating liquid is immersed the above-mentioned non-combustible paper, the conventional non-combustible paper, or a plane plate thin material (a non-combustible board, a foamed polystyrol, a corrugated board or the like), followed by drawing out, to thereby form a conductive layer on the surface of the paper or plate; a method in which the surface of the above-mentioned non-combustible paper, the conventional non-combustible paper, or a plane plate thin material (a non-combustible board, a foamed polystyrol, a corrugated board or the like) is coated with the above-mentioned conductive coating liquid using a brush or the like, to thereby form a conductive layer on the surface of the paper or plate; or a method in which the above-mentioned conductive coating liquid is sprayed on the surface of the non-combustible paper or the like, to thereby form a conductive layer on the surface of the paper or the like. In the present invention, it is especially preferred that a non-combustible paper is selected as thin material 2 from the viewpoints of the non-combustibility, the weight reduction, and the workability at the carrying and construction.

The term "non-combustible" used in the present invention means to be accepted by the constructional material test method (Notification No. 1828 of the Ministry of Construction) wherein a material which satisfies the requirement that when it is placed in a furnace at 750° C. for 20 min, the increase in the inner temperature of the furnace be 50° C. or less is judged as a non-combustible material.

With respect to the conductive material used, there is no particular limitation as long as it is conductive, and for example, carbon black, graphite, carbon fiber and the like can be used. In addition, as examples of the above-mentioned inorganic binders, there can be mentioned a water glass, a silica-alumina and the like; however, the inorganic binders are not limited to these binders.

The content of the conductive material in thin material 2 may be 5 to 80 g/m$^2$, preferably 20 to 50 g/m$^2$. When the conductive material content is less than 5 g/m$^2$, the radio wave absorption properties of thin material 2 become unsatisfactory. On the other hand, when the conductive material content is more than 80 g/m$^2$, not only become the radio wave absorption properties at a frequency of about 20 MHz unsatisfactory, but also the thin material disadvantageously becomes unacceptable in the non-combustion test mentioned below due to a high calorific value. The content of the conductive material in thin material 2 may be adjusted every part within the above-mentioned range.

The thickness of the above-mentioned thin material 2 may be 0.1 to 4 mm, preferably about 0.5 to 2 mm. The depth of concave portion 6 for folding may be 0.05 to 3 mm, preferably about 0.05 to 1 mm. Concave portion 6 for folding in thin material 2 may be formed by, for example, a method in which a die having a V-shaped cross-section is pushed, a method in which cutting is performed using a rotary blade, or the like.

FIG. 2 are explanatory views illustrating the method for producing a radio wave absorbent using the radio wave absorbent-assembling member shown in FIG. 1 and the radio wave absorbent of the present invention. The method for producing a radio wave absorbent of the present invention comprises folding radio wave absorbent-assembling member 1 at concave portions 6 for folding in thin material 2 (see FIG. 2(A)), and joining together the end portions of side plane members 3*a* and 3*d* by bonding joining member 5 to the end portion of side plane member 3*d* (see FIG. 2(B)), and superposing base plane members 4*a*, 4*b*, 4*c* and 4*d* on one another and joining together to form a base plane (see FIG. 2(C)), to thereby obtain radio wave absorbent 101 of the present invention (see FIG. 2(D)). As the adhesive used in the assembly of such a structure in the form of quadrangular pyramid, there can be used, for example, an adhesive cured by a hydration reaction, such as Portland cement and gypsum, or an inorganic adhesive, such as a phosphate, a silica sol and a water glass composition. Especially preferred is a water glass composition which is inexpensive and has a high bonding property. Water glass is an aqueous solution which is mainly made of an alkali metal silicate, and sodium silicate is especially preferred because it is inexpensive and easily available as a product meeting Japanese Industrial Standard (JIS). Further, a mixture of a water glass of sodium silicate and that of lithium silicate may be used.

A pedestal plate containing a conductive material and having a dielectric loss is arranged on the bottom portion of radio wave absorbent 101. By arranging such a pedestal plate having a dielectric loss, not only the radio wave absorption properties in a frequency band of about several tens MHz to several GHz but also those in a high frequency band of several tens GHz can be compensated.

Second embodiment

Figure 3:
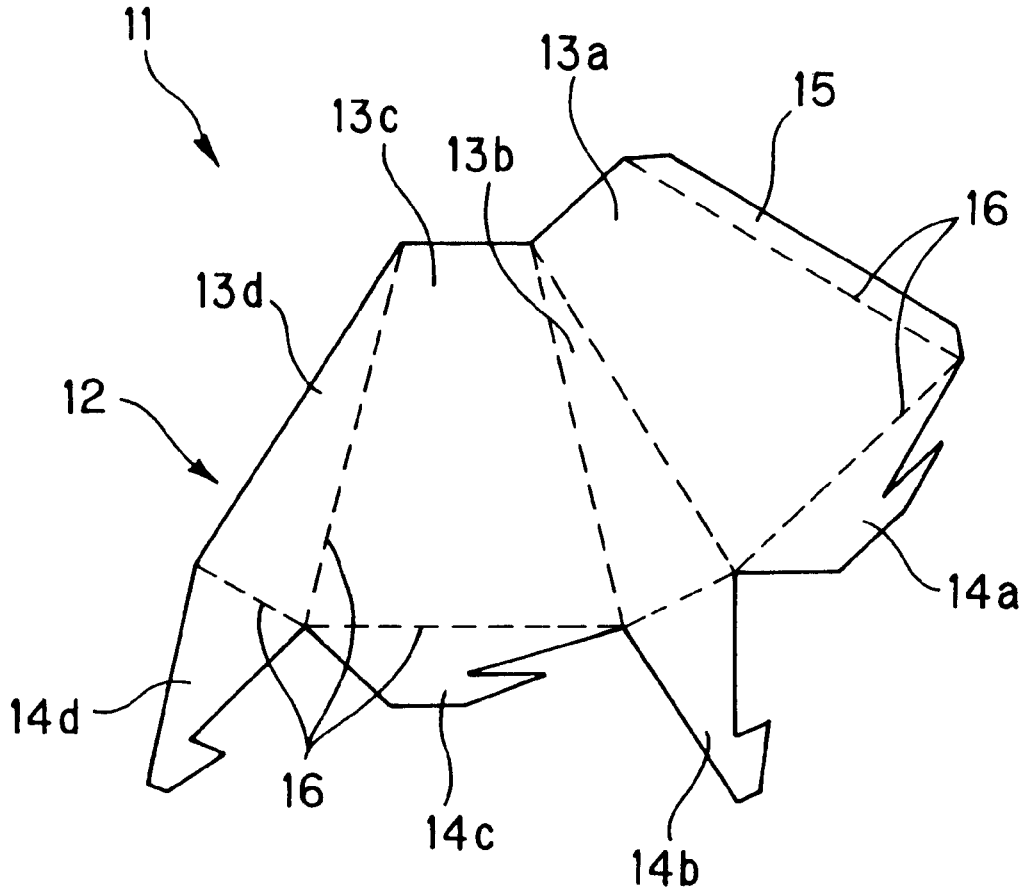
FIG. 3 is a plan view showing another embodiment of the radio wave absorbent-assembling member of the present invention.
Figure 4A:
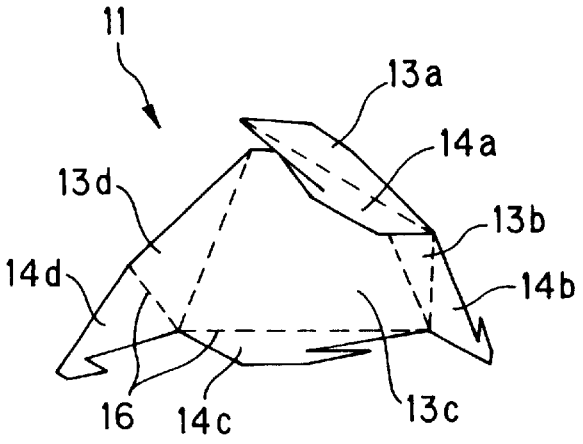
FIGS. 4A–4D are explanatory views illustrating the method for producing a radio wave absorbent using the radio wave absorbent-assembling member shown in FIG. 3 and the radio wave absorbent of the present invention.
Figure 4B:
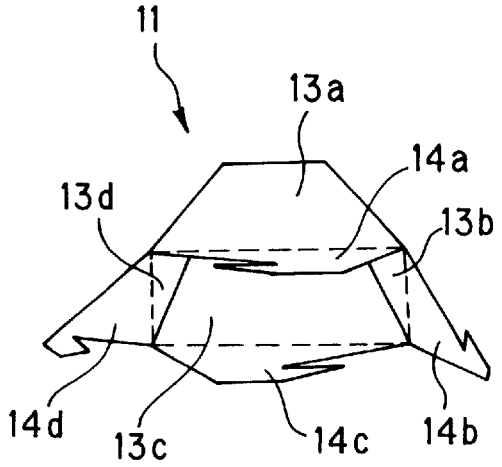
Figure 4C:
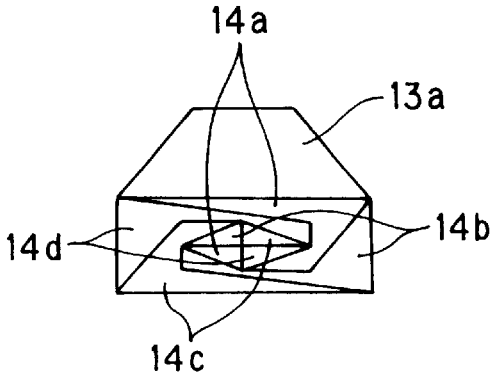
Figure 4D:
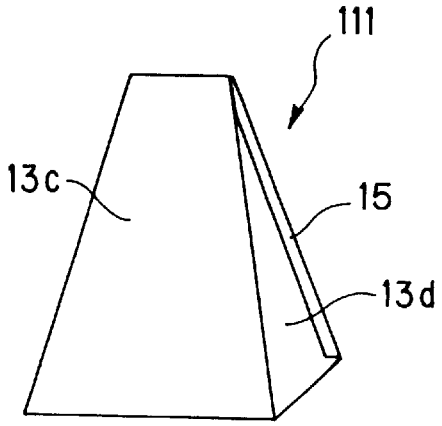

FIG. 3 is a plan view showing another embodiment of the radio wave absorbent-assembling member of the present invention. In FIG. 3, radio wave absorbent-assembling member 11 comprises radio wave absorptive thin material 12 which is capable of assembling a structure in a desired form. In the example shown in this figure, thin material 12 is capable of assembling a structure in the form of wedge, and comprises oblique plane members 13*a* and 13*c* which constitute the oblique planes of the wedge form, side plane members 13*b* and 13*d* which constitute the side planes, base plane members 14*a*, 14*b*, 14*c* and 14*d* which constitute the base plane, and joining member 15. Each of the above-mentioned base plane members 14*a*, 14*b*, 14*c* and 14*d* has a form such that they are superposed on one another at the time of assembly to constitute the base plane. Further, thin material 12 has concave portions 16 (indicated by chain lines) for folding at the respective boundaries between the above-mentioned members. With respect to thin material 12, the types of material and the thickness and the like can be selected similarly to those in the case of the above-mentioned thin material 2 of radio wave absorbent-assembling member 1. Therefore, an explanation about these is omitted here.

FIG. 4 are explanatory views illustrating the method for producing a radio wave absorbent using the radio wave absorbent-assembling member shown in FIG. 3 and the radio wave absorbent of the present invention. The method for producing a radio wave absorbent of the present invention comprises folding radio wave absorbent-assembling member 11 at concave portions 16 for folding in thin material 12 (see FIG. 4(A)), and joining together the end portion of oblique plane member 13*a* and the end portion of side plane member 13*d* by bonding joining member 15 to the end portion of side plane member 13*d* (see FIG. 4(B)), and superposing base plane members 14*a*, 14*b*, 14*c* and 14*d* on one another and joining together to form a base plane (see FIG. 4(C)), to thereby obtain radio wave absorbent 111 in the form of wedge of the present invention (see FIG. 4(D)). As the adhesive used in the assembly, the above-mentioned inorganic adhesives can be mentioned.

Further, the above-mentioned pedestal plate having a dielectric loss may also be arranged on the bottom portion of radio wave absorbent 111.

Third embodiment

Figure 5:
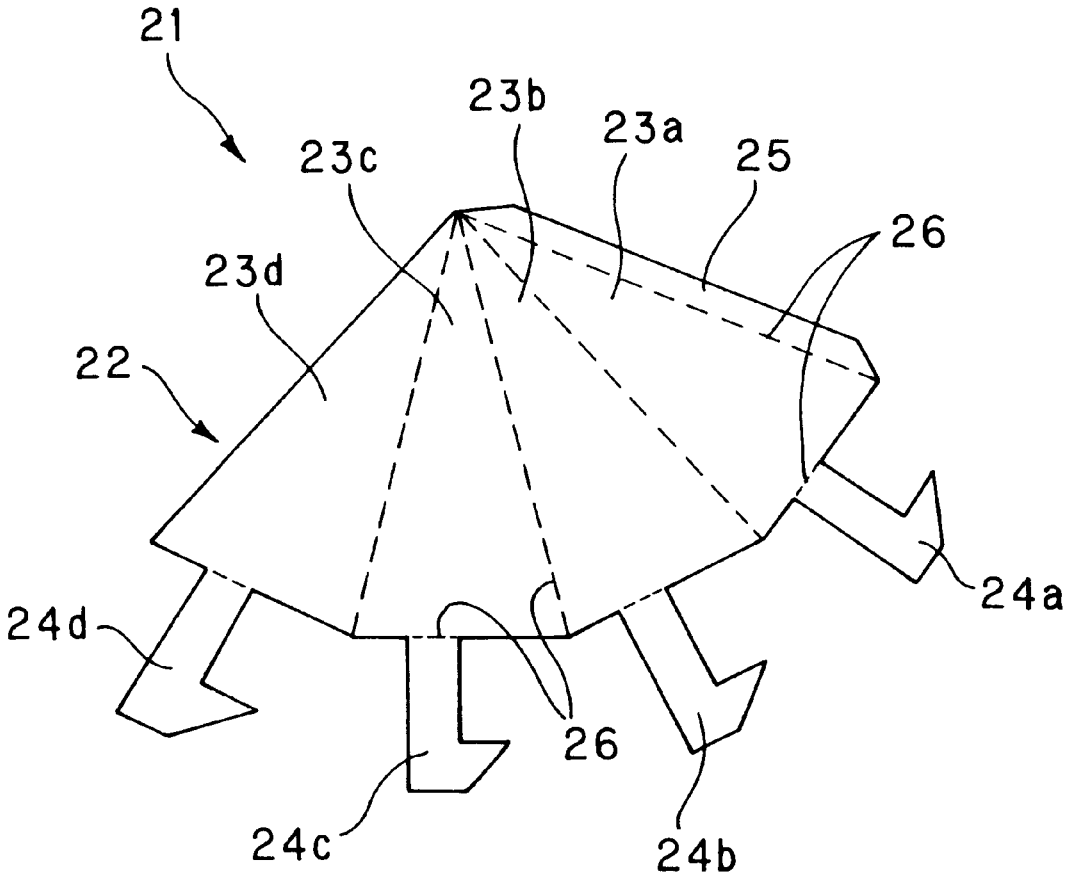
FIG. 5 is a plan view showing another embodiment of the radio wave absorbent-assembling member of the present invention.
Figure 6A:
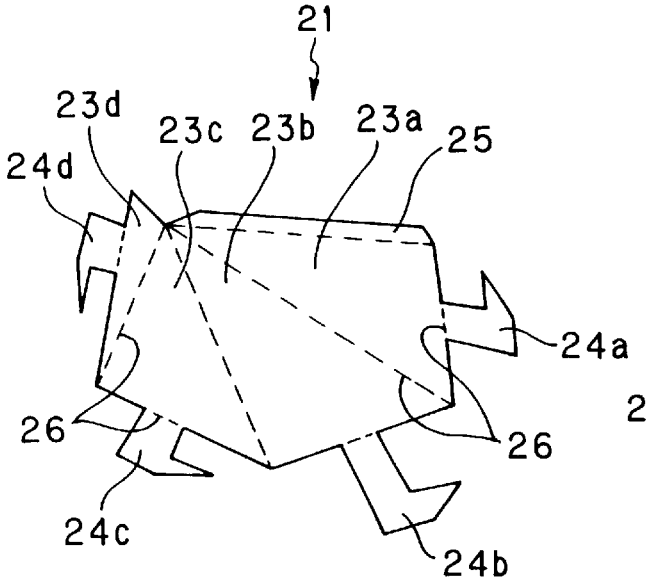
FIGS. 6A–6D are explanatory views illustrating the method for producing a radio wave absorbent using the radio wave absorbent-assembling member shown in FIG. 5 and the radio wave absorbent of the present invention.
Figure 6B:
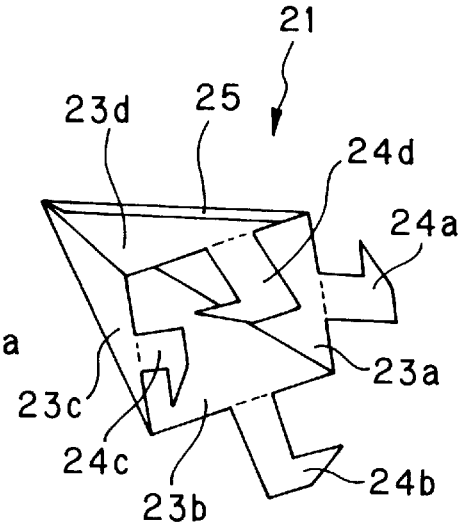
Figure 6C:
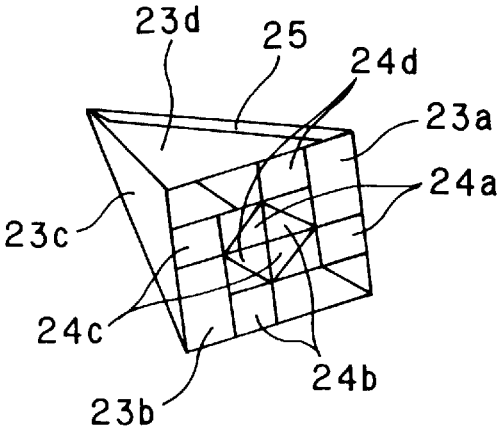
Figure 6D:
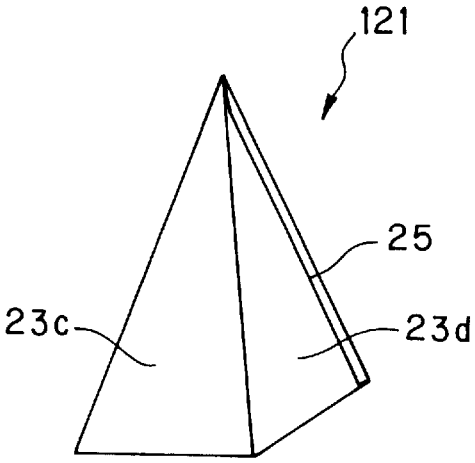

FIG. 5 is a plan view showing another embodiment of the radio wave absorbent-assembling member of the present invention. In FIG. 5, radio wave absorbent-assembling member 21 comprises radio wave absorptive thin material 22 which is capable of assembling a structure in a desired form. In the example shown in this figure, thin material 22 is capable of assembling a structure in the form of quadrangular pyramid, and comprises side plane members 23*a*, 23*b*, 23*c* and 23*d* which constitute the side planes of the quadrangular pyramid form, connecting members 24*a*, 24*b*, 24*c* and 24*d* which connect the bases of the respective side planes, and joining member 25. Each of the above-mentioned connecting members 24*a*, 24*b*, 24*c* and 24*d* has a form such that they are superposed on one another at the time of assembly. Further, thin material 22 has concave portions 26 (indicated by chain lines) for folding at the respective boundaries between the above-mentioned members. With respect to thin material 22, the types of material and the thickness and the like can be selected similarly to those in the case of the above-mentioned thin material 2 of radio wave absorbent-assembling member 1. Therefore, an explanation about these is omitted here.

FIGS. 6 are explanatory views illustrating the method for producing a radio wave absorbent using the radio wave absorbent-assembling member shown in FIG. 5 and the radio wave absorbent of the present invention. The method for producing a radio wave absorbent of the present invention comprises folding radio wave absorbent-assembling member 21 at concave portions 26 for folding in thin material 22 (see FIG. 6(A)), and joining together the end portions of side plane members 23*a* and 23*d* by bonding joining member 25 to the end portion of side plane member 23*d* (see FIG. 6(B)), and superposing connecting members 24*a*, 24*b*, 24*c* and 24*d* on one another and joining together (see FIG. 6(C)), to thereby obtain radio wave absorbent 121 of the present invention (see FIG. 6(D)). As the adhesive used in the assembly of such a structure in the form of quadrangular pyramid, the above-mentioned inorganic adhesives can be mentioned.

Further, the above-mentioned pedestal plate having a dielectric loss may also be arranged on the bottom portion of radio wave absorbent 121.

Fourth embodiment

Figure 7:
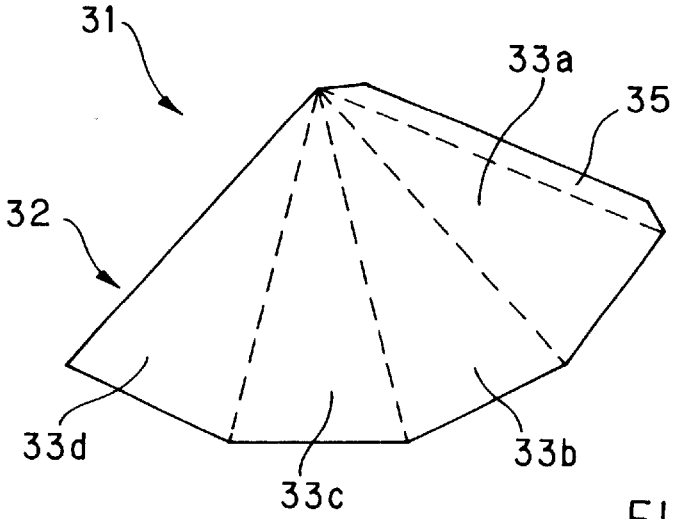
FIG. 7 is a plan view showing another embodiment of the radio wave absorbent-assembling member of the present invention.

FIG. 7 is a plan view showing another embodiment of the radio wave absorbent-assembling member of the present invention. In FIG. 7, radio wave absorbent-assembling member 31 comprises radio wave absorptive thin material 32 which is capable of assembling a structure in a desired form. In the example shown in this figure, thin material 32 is capable of assembling a structure in the form of quadrangular pyramid, and comprises side plane members 33*a*, 33*b*, 33*c* and 33*d* which constitute the side planes of the quadrangular pyramid form, and joining member 35. Further, thin material 32 has concave portions 36 (indicated by chain lines) for folding at the respective boundaries between the above-mentioned members. With respect to thin material 32, the types of material and the thickness and the like can be selected similarly to those in the case of the above-mentioned thin material 2 of radio wave absorbent-assembling member 1. Therefore, an explanation about these is omitted here.

Figure 8A:
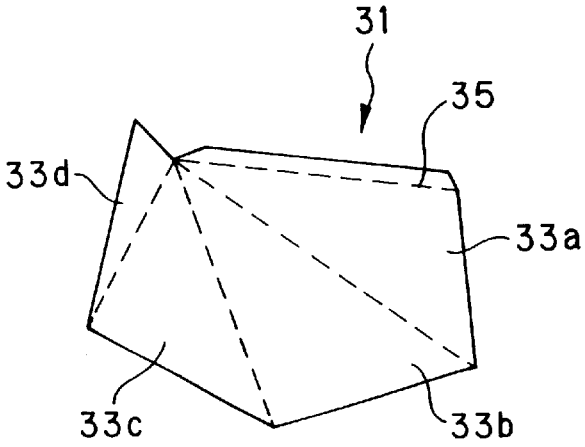
FIGS. 8A–8C are explanatory views illustrating the method for producing a radio wave absorbent using the radio wave absorbent-assembling member shown in FIG. 7 and the radio wave absorbent of the present invention.
Figure 8B:
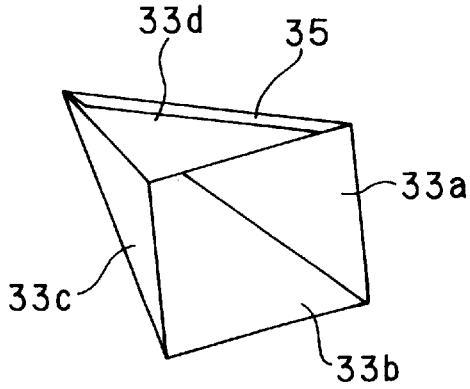
Figure 8C:
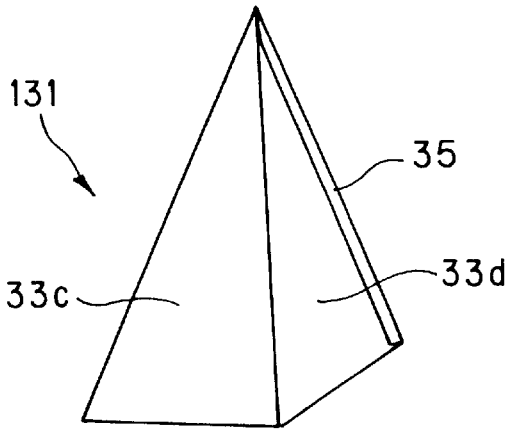

FIG. 8 are explanatory views illustrating the method for producing a radio wave absorbent using the radio wave absorbent-assembling member shown in FIG. 7 and the radio wave absorbent of the present invention. The method for producing a radio wave absorbent of the present invention comprises folding radio wave absorbent-assembling member 31 at concave portions 36 for folding in thin material 32 (see FIG. 8(A)), and joining together the end portions of side plane members 33*a* and 33*d* by bonding joining member 35 to the end portion of side plane member 33*d* (see FIG. 8(B)), to thereby obtain radio wave absorbent 131 of the present invention (see FIG. 8(C)). As the adhesive used in the assembly of such a structure in the form of quadrangular pyramid, the above-mentioned inorganic adhesives can be mentioned.

Further, the above-mentioned pedestal plate having a dielectric loss may also be arranged on the bottom portion of radio wave absorbent 131.

Fifth embodiment

Figure 9:
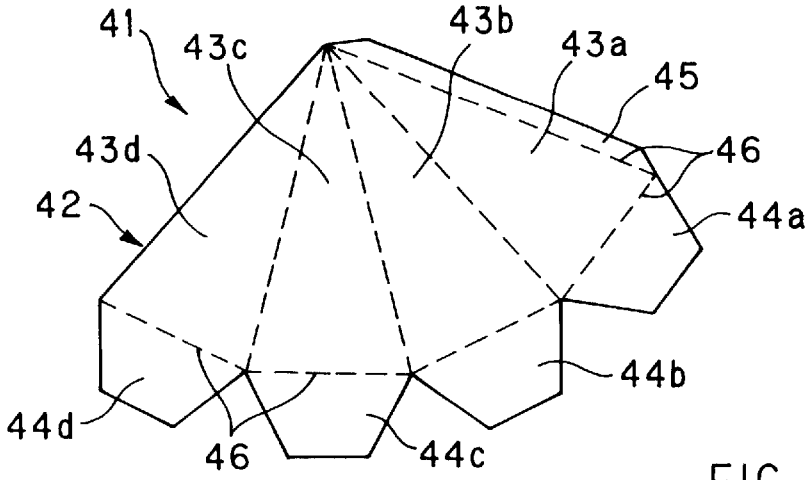
FIG. 9 is a plan view showing another embodiment of the radio wave absorbent-assembling member of the present invention.

FIG. 9 is a plan view showing another embodiment of the radio wave absorbent-assembling member of the present invention. In FIG. 9, radio wave absorbent-assembling member 41 comprises radio wave absorptive thin material 42 which is capable of assembling a structure in a desired form. In the example shown in this figure, thin material 42 is capable of assembling a structure in the form of quadrangular pyramid, and comprises side plane members 43*a*, 43*b*, 43*c* and 43*d* which constitute the side planes of the quadrangular pyramid form, connecting members 44*a*, 44*b*, 44*c* and 44*d* which are used when a unit comprising a plurality of radio wave absorbents is formed as mentioned below, and joining member 45. Further, thin material 42 has concave portions 46 (indicated by chain lines) for folding at the respective boundaries between the above-mentioned members. With respect to thin material 42, the types of material and the thickness and the like can be selected similarly to those in the case of the above-mentioned thin material 2 of radio wave absorbent-assembling member 1. Therefore, an explanation about these is omitted here.

Figure 10A:
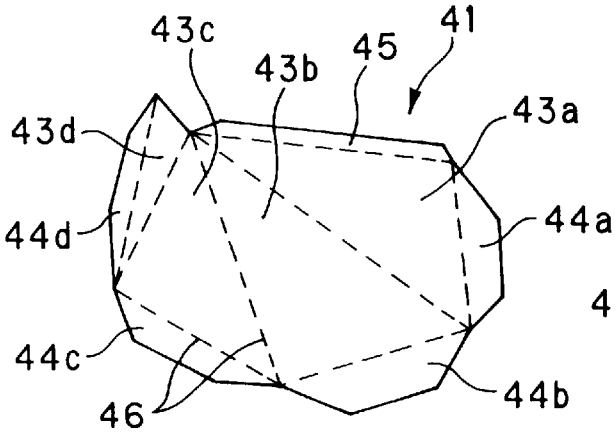
FIGS. 10A–10C are explanatory views illustrating the method for producing a radio wave absorbent using the radio wave absorbent-assembling member shown in FIG. 9 and the radio wave absorbent of the present invention.
Figure 10B:
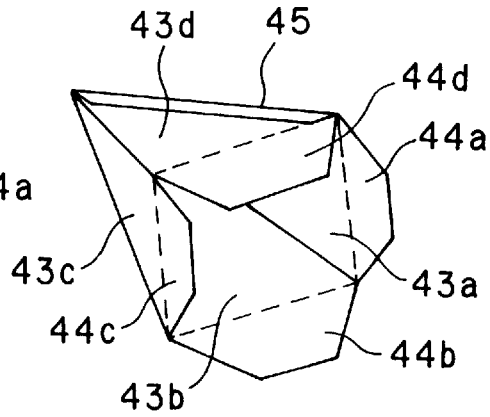
Figure 10C:
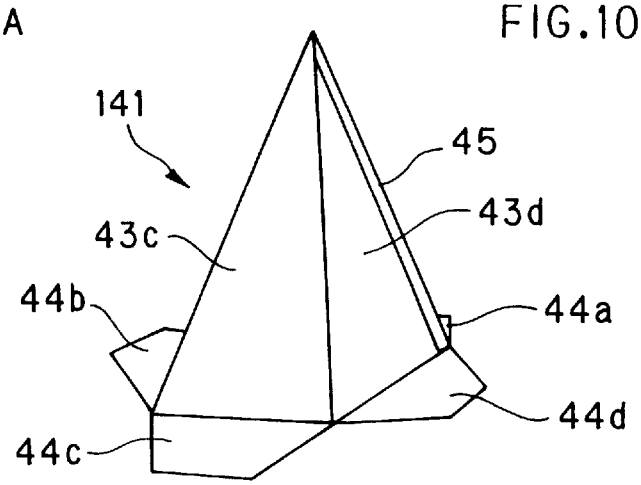

FIG. 10 are explanatory views illustrating the method for producing a radio wave absorbent using the radio wave absorbent-assembling member shown in FIG. 9 and the radio wave absorbent of the present invention. The method for producing a radio wave absorbent of the present invention comprises folding radio wave absorbent-assembling member 41 at concave portions 46 for folding in thin material 42 (see FIG. 10(A)), and joining together the end portions of side plane members 43*a* and 43*d* by bonding joining member 45 to the end portion of side plane member 43*d* (see FIG. 10(B)), and folding outward connecting members 44*a*, 44*b*, 44*c* and 44*d* at concave portions 46, to thereby obtain radio wave absorbent 141 in the form of quadrangular pyramid of the present invention (see FIG. 10(C)). As the adhesive used in the assembly, the above-mentioned inorganic adhesives can be mentioned.

Further, the above-mentioned pedestal plate having a dielectric loss may also be arranged on the bottom portion of radio wave absorbent 141 without sacrificing the functions of connecting members 44*a*, 44*b*, 44*c* and 44*d*.

Figure 11:
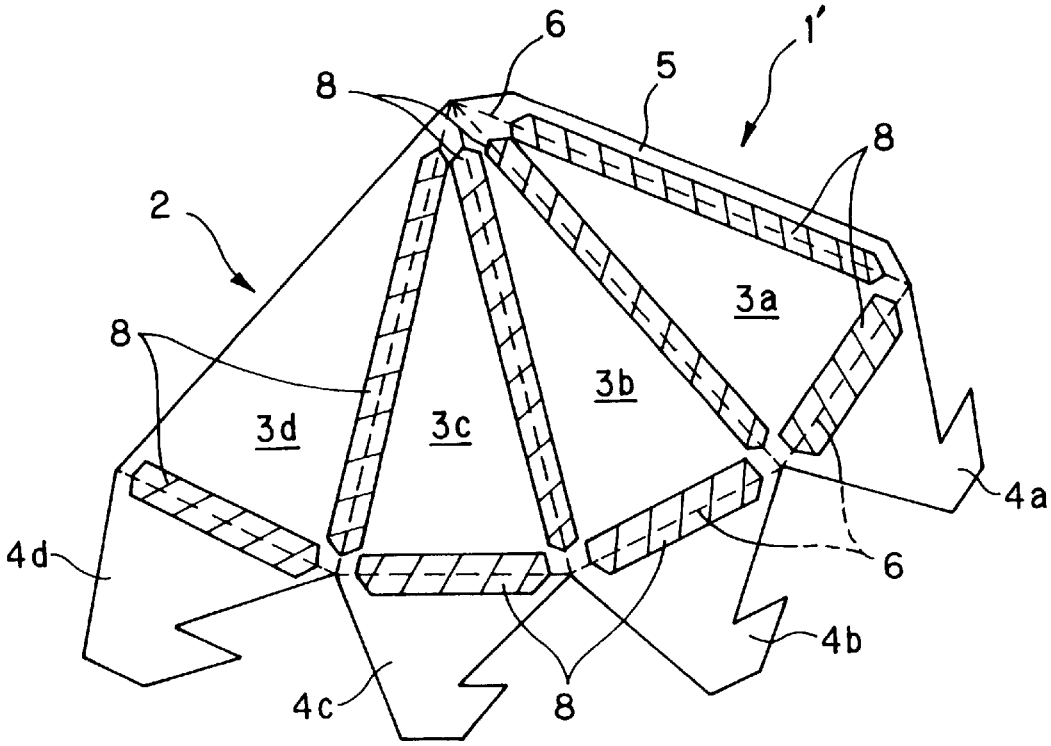
FIG. 11 is a plan view showing one example of the radio wave absorbent-assembling member of the present invention, in which the radio wave absorbent-assembling member shown in FIG. 1 has a reinforcing member.

In the present invention, the portion for folding in the radio wave absorbent-assembling members mentioned in the above first to fifth embodiments may have a reinforcing member. FIG. 11 is a plan view showing one example of the radio wave absorbent-assembling member of the present invention, in which radio wave absorbent-assembling member 1 shown in FIG. 1 has a reinforcing member. In FIG. 11, radio wave absorbent-assembling member 1' comprises reinforcing members 8 which are fixed on concave portions 6 using an inorganic adhesive. As reinforcing member 8, there can be mentioned those which are formed into a sheet form using an inorganic adhesive, such as a fire-resistant fiber or a glass fiber. As the inorganic adhesive used, the above-mentioned inorganic adhesives can be mentioned.

Figure 12:
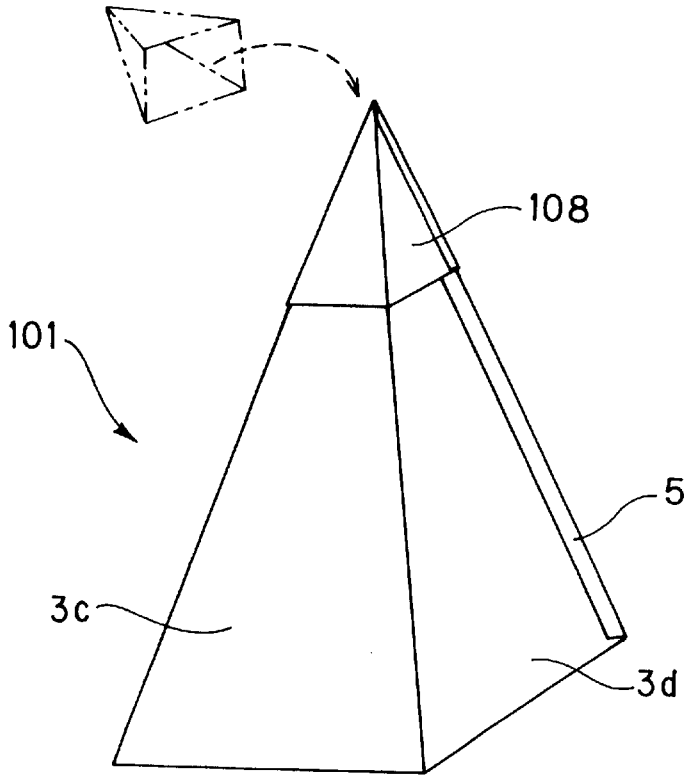
FIG. 12 is a perspective view showing one form of the radio wave absorbent of the present invention, in which the radio wave absorbent shown in FIG. 2 has a reinforcing member.

Further, in the present invention, the radio wave absorbent mentioned in the above first to fifth embodiments may have a reinforcing member for reinforcing the tip portion. FIG. 12 is a perspective view showing one example of the radio wave absorbent of the present invention, in which radio wave absorbent 101 shown in FIG. 2 has a reinforcing member. In FIG. 12, radio wave absorbent 101 in the form of quadrangular pyramid comprises reinforcing member 108 which is in the form of quadrangular pyramid (base plane is open) similar to radio wave absorbent 101 and fixed on the top portion of radio wave absorbent 101 using an inorganic adhesive. This reinforcing member 108 in the form of quadrangular pyramid can be produced by, for example, punching a sheet, which is formed from a fire-resistant fiber, a glass fiber or the like using an inorganic adhesive, into the form of radio wave absorbent-assembling member 31 shown in FIG. 7, and assembling the punched radio wave absorbent-assembling member using an inorganic adhesive. As the inorganic adhesive used, the above-mentioned inorganic adhesives can be mentioned.

The joining member used for the radio wave absorbent-assembling member of the present invention is not limited to the embodiments described in the above-mentioned first to fifth embodiments. Hereinbelow, explanations on the joining member will be made, taking as an example radio wave absorbent-assembling member 1 shown in FIG. 1, with reference to FIGS. 13 to 15.

Figure 13A:
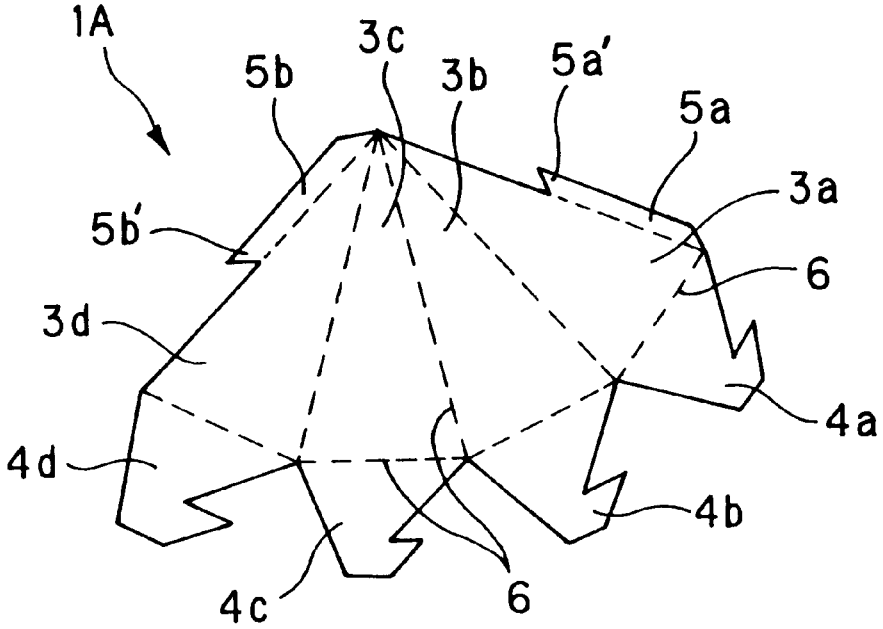
FIGS. 13A and 13B are explanatory views illustrating another construction of a joining member in the radio wave absorbent-assembling member of the present invention.
Figure 13B:
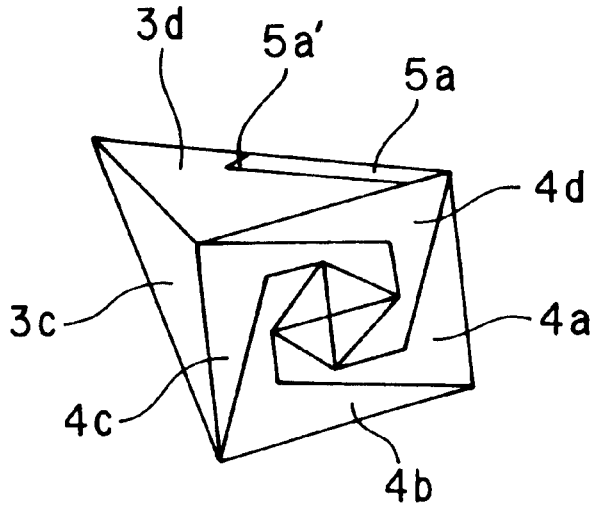

Radio wave absorbent-assembling member 1A shown in FIG. 13 is basically the same as radio wave absorbent-assembling member 1 shown in FIG. 1 except that the construction of joining member 5 is different. Specifically, the joining member comprises joining member 5*a* which is provided on the end portion of side plane member 3*a* constituting the side plane at about half portion on the side of the base plane and joining member 5*b* which is provided on the end portion of side plane member 3*d* at about half portion on the side of the top portion (see FIG. 13(A)). Side end portions 5*a*' and 5*b*' on the side of the center of respective joining members 5*a* and 5*b* constitute a superposing portion having an acute angle tip. When radio wave absorbent-assembling member 1A is folded at concave portions 6 for folding to assemble a radio wave absorbent, at the joining of the end portion of side plane member 3*a* and the end portion of side plane member 3*d*, the above-mentioned joining members 5*a* and 5*b* respectively are secured by side end portions (superposing portions) 5*a*' and 5*b*' on the side of the center (see FIG. 13(B)). Therefore, the assembling operation is easy. Joining members 5*a* and 5*b* are preliminarily coated with an adhesive. Therefore, the setting of the adhesive progresses in a state such that the joining members are secured as mentioned above, so that joining member 5*a* is fixed on side plane member 3*d* and joining member 5*b* is fixed on side plane member 3*a*.

Figure 14A:
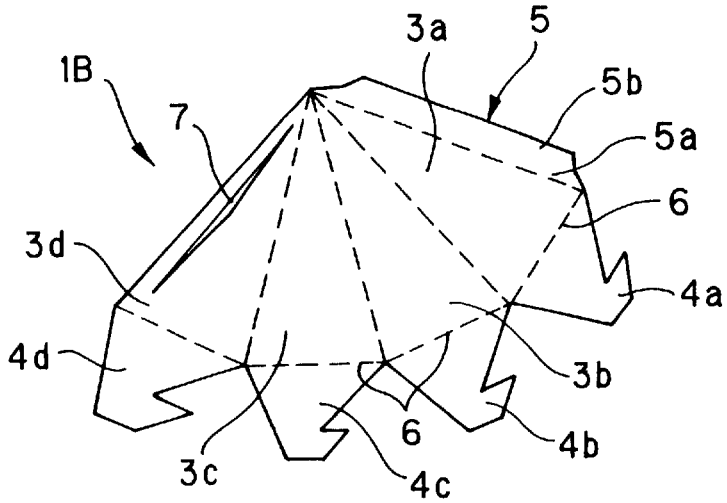
FIGS. 14A–14C are explanatory views illustrating another construction of a joining member in the radio wave absorbent-assembling member of the present invention.
Figure 14B:
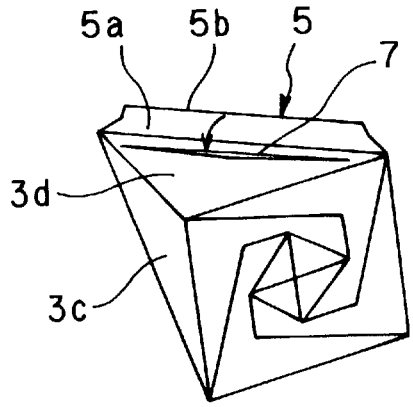
Figure 14C:
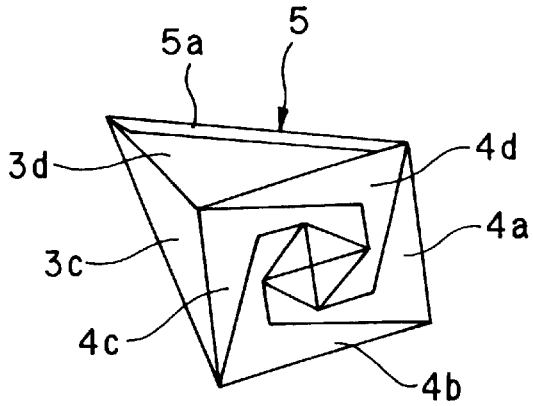

Radio wave absorbent-assembling member 1B shown in FIG. 14 is basically the same as radio wave absorbent-assembling member 1 shown in FIG. 1 except that the construction of joining member 5 is different. Specifically, the joining member comprises base portion 5*a* and tip portion 5*b* having a width a little smaller than that of base portion 5*a*. On the other hand, around the end portion of side plane member 3*d* has notch portion 7 corresponding to the above-mentioned tip portion 5*b* (see FIG. 14(A)). When radio wave absorbent-assembling member 1B is folded at concave portions 6 for folding to assemble a radio wave absorbent, at the joining of the end portion of side plane member 3*a* and the end portion of side plane member 3*d*, tip portion 5*b* of joining member 5 which is preliminarily coated with an adhesive is inserted into notch portion 7 of side plane member 3*d* (see FIG. 14(B)), so that the end portion of side plane member 3*a* and the end portion of side plane member 3*d* are secured with each other (see FIG. 14(C)). Then, the setting of the adhesive progresses in a state such that the end portions are secured as mentioned above, so that base portion 5*a* of joining member 5 is fixed on side plane member 3*d*. Therefore, the assembling operation is easy.

Figure 15A:
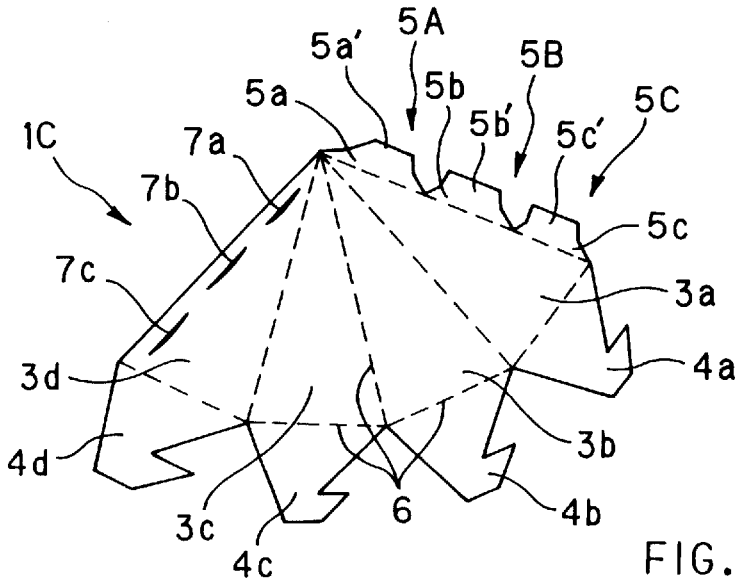
FIGS. 15A–15C are explanatory views illustrating another construction of a joining member in the radio wave absorbent-assembling member of the present invention.
Figure 15B:
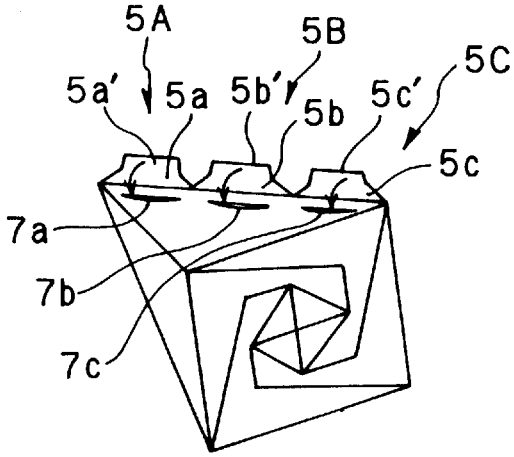
Figure 15C:
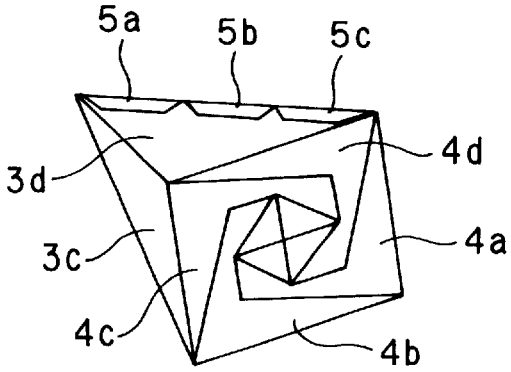

Radio wave absorbent-assembling member 1C shown in FIG. 15 is basically the same as radio wave absorbent-assembling member 1 shown in FIG. 1 except that the construction of joining member 5 is different. Specifically, joining member 5 which is provided on the end portion of side plane member 3*a* constituting the side plane comprises three joining members 5A, 5B and 5C. Joining members 5A, 5B and 5C respectively comprise base portions 5*a*, 5*b* and 5*c* and tip portions 5*a*', 5*b*' and 5*c*' each having a width a little smaller than that of the corresponding base portion. On the other hand, around the end portion of side plane member 3*d* has three notch portions 7*a*, 7*b* and 7*c* respectively corresponding to the above-mentioned three tip portions 5*a*', 5*b*' and 5*c*' (see FIG. 15(A)). When radio wave absorbent-assembling member 1C is folded at concave portions 6 for folding to assemble a radio wave absorbent, at the joining of the end portion of side plane member 3*a* and the end portion of side plane member 3*d*, tip portions 5*a*', 5*b*' and 5*c*' of joining members 5A, 5B and 5C which are preliminarily coated with an adhesive are respectively inserted into notch portions 7*a*, 7*b* and 7*c* of side plane member 3*d* (see FIG. 15(B)), so that the end portion of side plane member 3*a* and the end portion of side plane member 3*d* are secured with each other (see FIG. 15(C)). Then, the setting of the adhesive progresses in a state such that the end portions are secured as mentioned above, so that base portions 5*a*, 5*b* and 5*c* of joining members 5A, 5B and 5C are fixed on side plane member 3*d*. Therefore, the assembling operation is easy.

Hereinbelow, another embodiments of the radio wave absorbent of the present invention and the method for producing the same will be described.

In the present invention, in addition to the radio wave absorbent and the method for producing the same mentioned in the above first to fifth embodiments, a plurality of the produced radio wave absorbents are connected to each other to form a single unit, and a frame member can be fixed for supporting on the periphery of the lower portion of the above unit.

Figure 16:
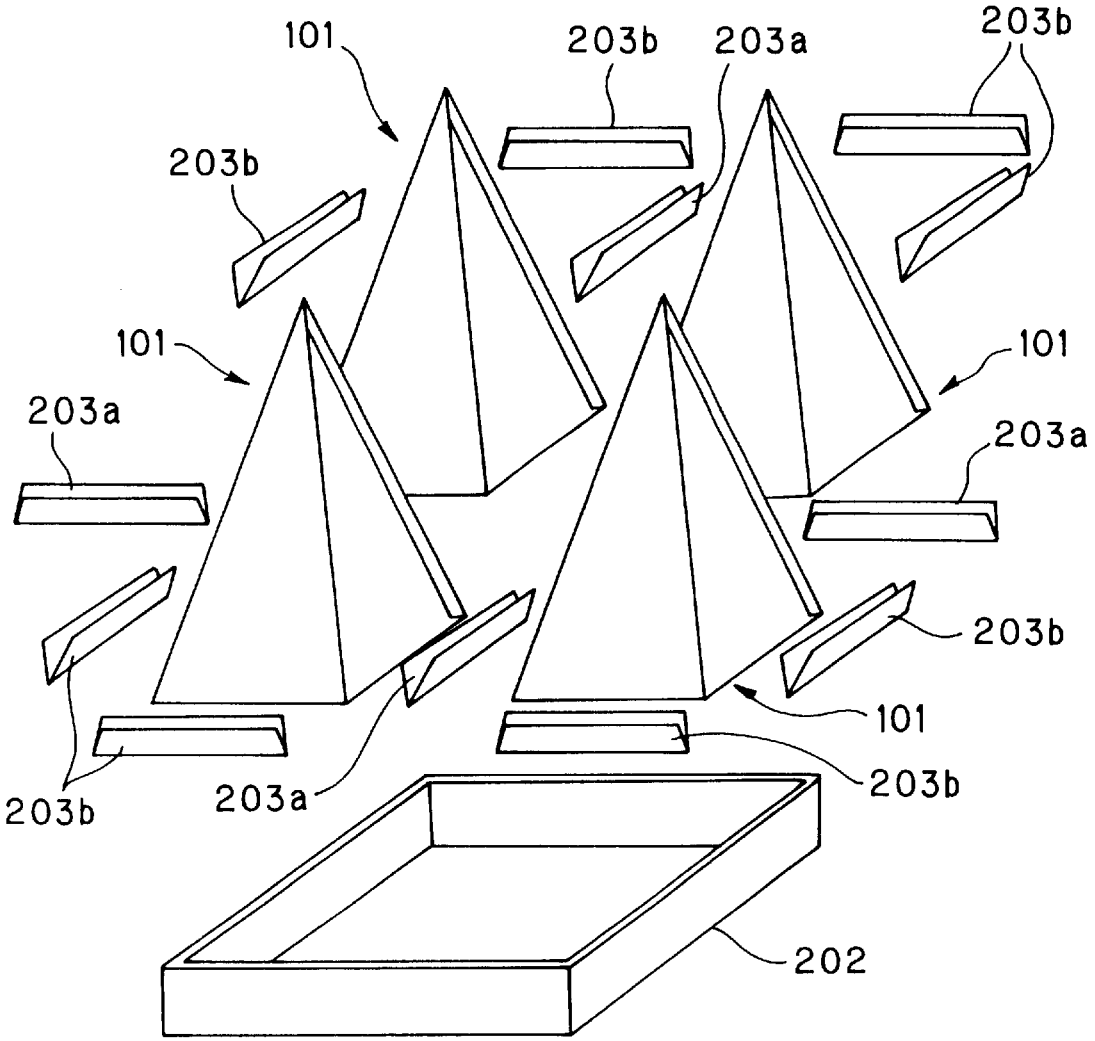
FIG. 16 is an explanatory view illustrating another example of the method for producing the radio wave absorbent of the present invention.
Figure 17:
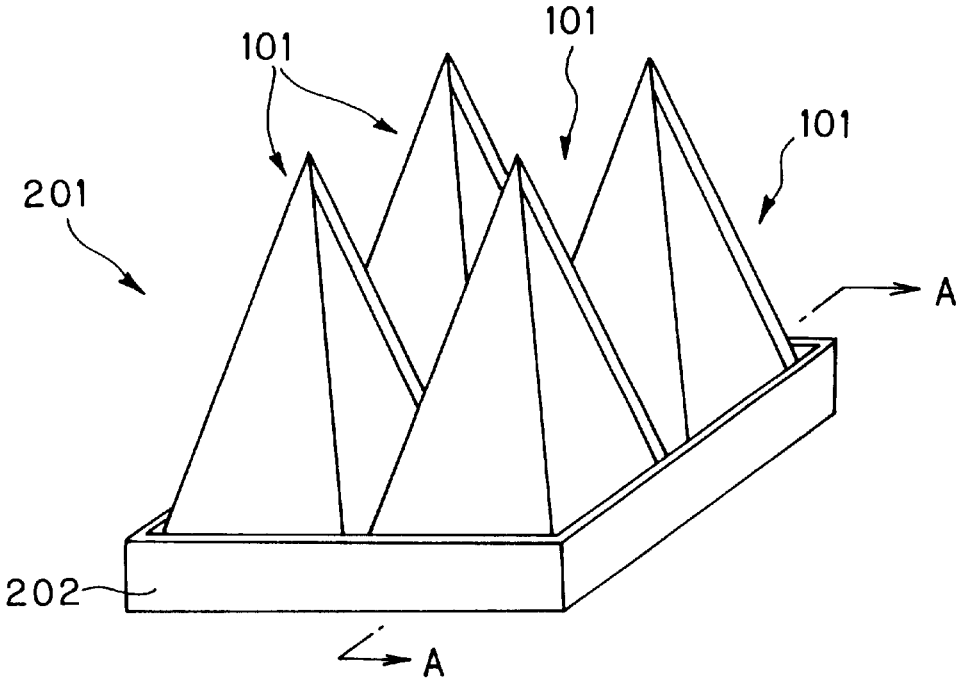
FIG. 17 is a perspective view showing another example of the radio wave absorbent of the present invention.
Figure 18:
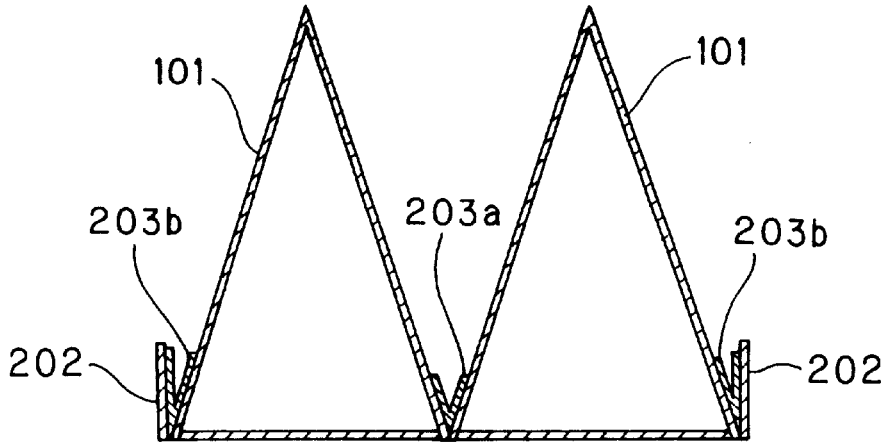
FIG. 18 is a longitudinal sectional view of the radio wave absorbent taken along the line A—A in FIG. 17.

FIG. 16 is a perspective view showing an example of the production of a radio wave absorbent as a unit by such a method. In FIG. 16, the base portions of the side planes of four radio wave absorbents 101 are connected to each other using four connecting members 203*a*, to thereby form a single unit. The unit is installed in frame member 202 in the corresponding form, and the base portions of the side planes of radio wave absorbents 101 and frame member 202 are connected to each other using eight connecting members 203*b*, to thereby obtain radio wave absorbent 201 as a single unit shown in FIGS. 17 and 18. FIG. 18 is a longitudinal sectional view of the radio wave absorbent taken along the line A—A in FIG. 17.

Figure 19:
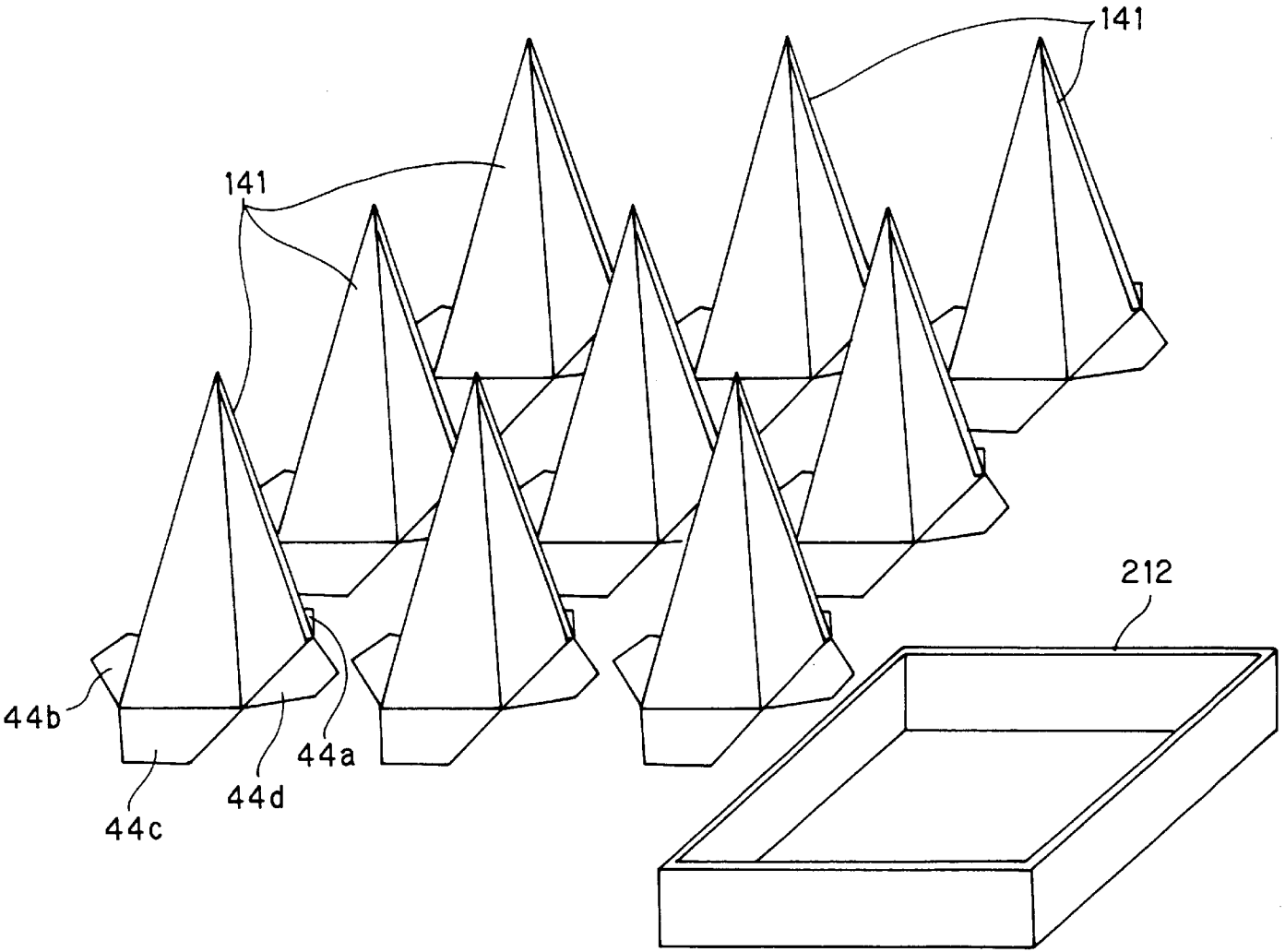
FIG. 19 is an explanatory view illustrating another example of the method for producing the radio wave absorbent of the present invention.
Figure 20:
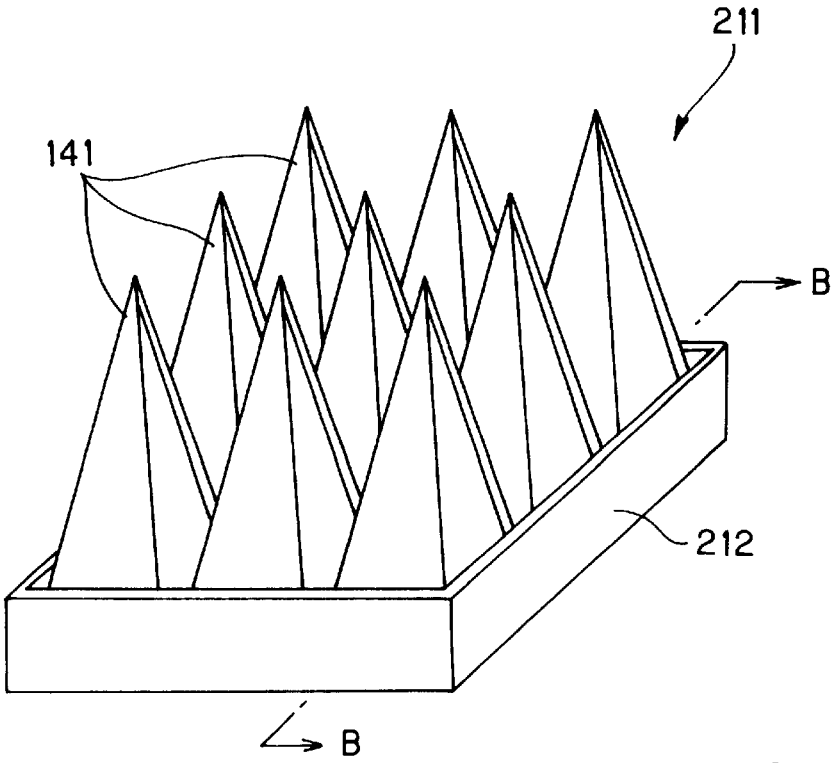
FIG. 20 is a perspective view showing another example of the radio wave absorbent of the present invention.
Figure 21:
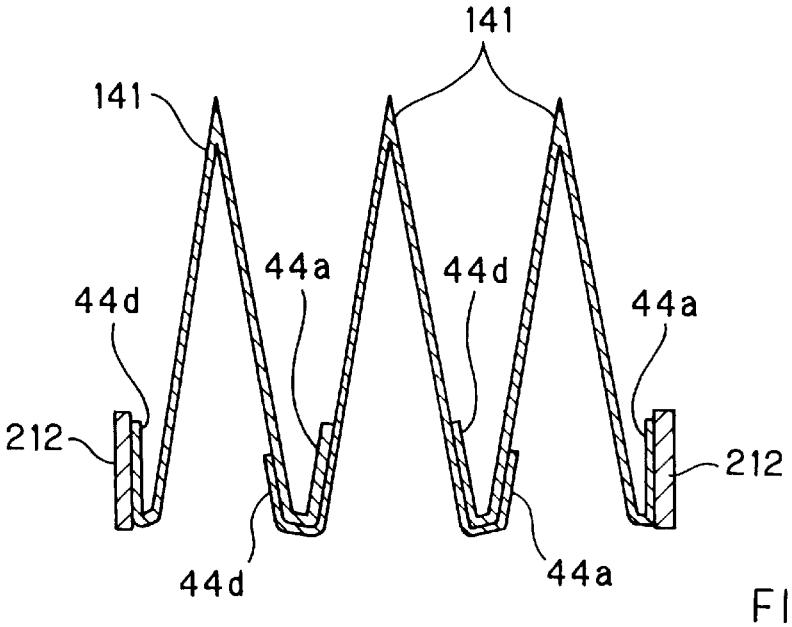
FIG. 21 is a longitudinal sectional view of the radio wave absorbent taken along the line B—B in FIG. 20.
Figure 22:
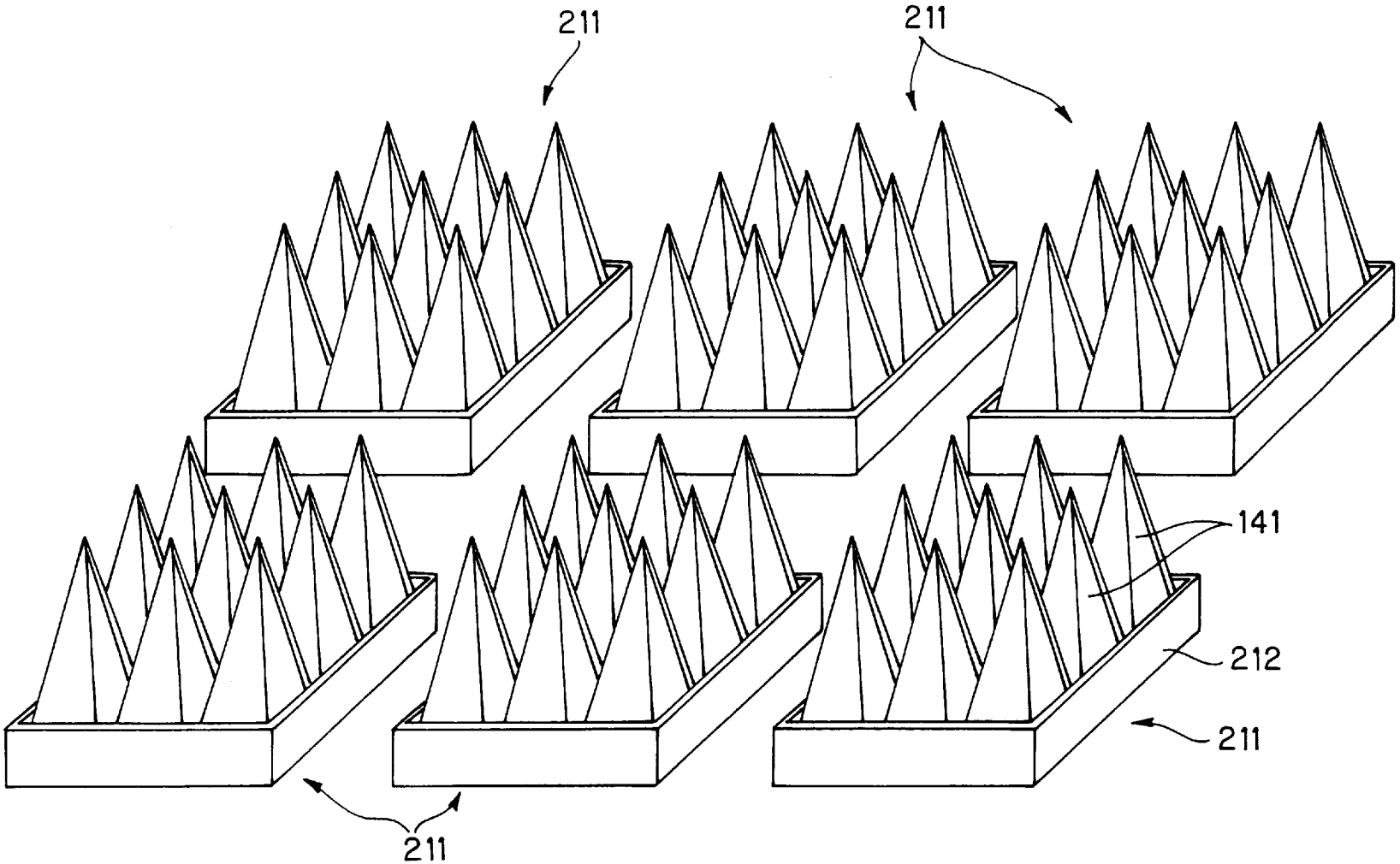
FIG. 22 is an explanatory view illustrating one form of the construction of an anechoic chamber using the radio wave absorbent of the present invention.

FIG. 19 is a perspective view showing another example of the production of a radio wave absorbent as a unit. In FIG. 19, connecting members 44*a*, 44*b*, 44*c* and 44*d* of nine radio wave absorbents 141 are contacted with the surfaces or inner surfaces of adjacent radio wave absorbents 141, and adjacent radio wave absorbents 141 are connected to each other through the above connecting members 44*a*, 44*b*, 44*c* and 44*d* using an inorganic adhesive, to thereby form a single unit. Then, the unit is installed in frame member 212 in the corresponding form, and radio wave absorbents 141 and frame member 212 are connected to each other through connecting members 44*a*, 44*b*, 44*c* and 44*d*, which are located on the outside of the unit, using an inorganic adhesive, to thereby obtain radio wave absorbent 211 as a single unit shown in FIGS. 20 and 21. FIG. 21 is a longitudinal sectional view of the radio wave absorbent taken along the line B—B in FIG. 20.

Figure 23:
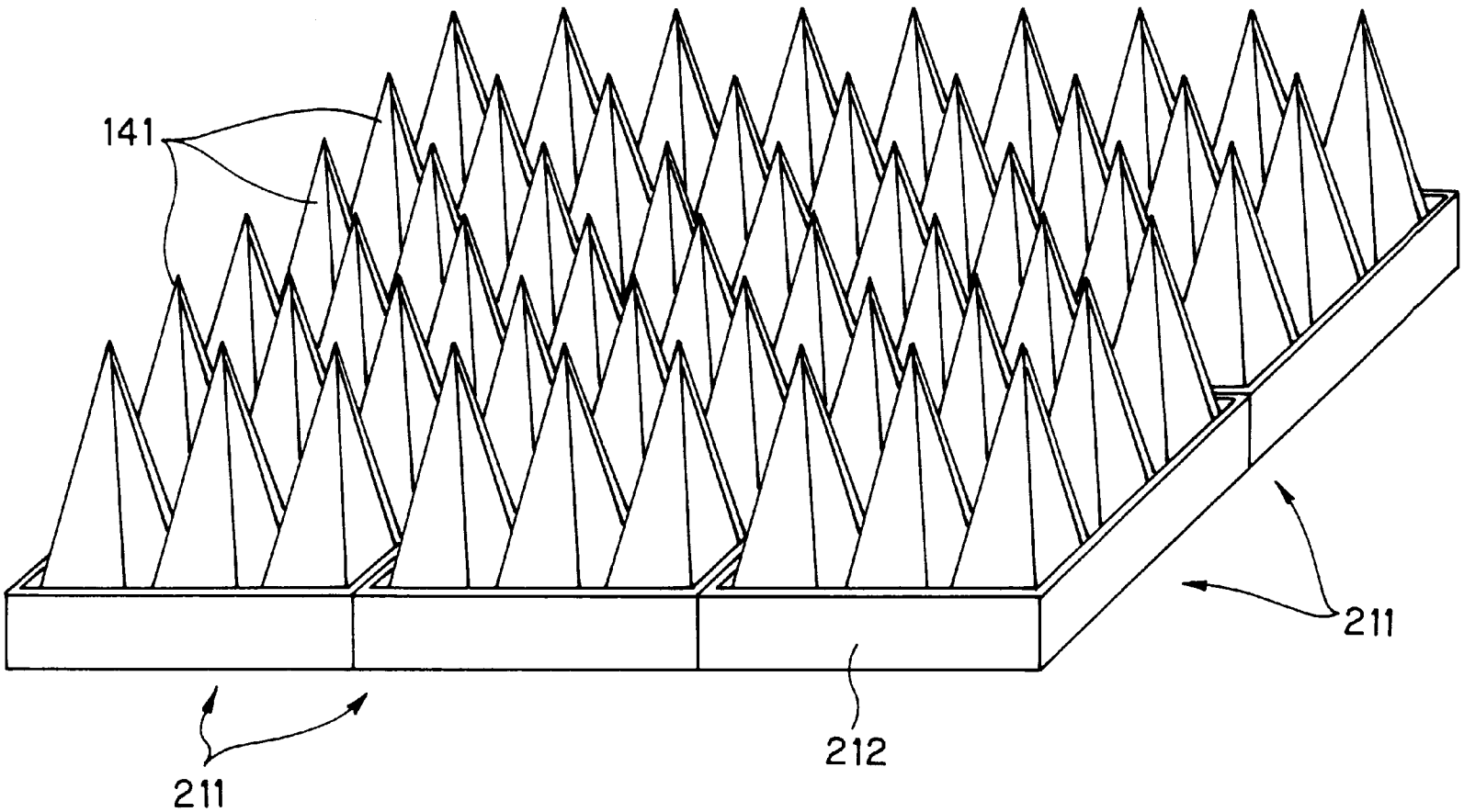
FIG. 23 is an explanatory view illustrating one form of the construction of an anechoic chamber using the radio wave absorbent of the present invention.

Thus obtained radio wave absorbents 201 and 211 as a single unit are advantageous not only in that they can be handled unit by unit at the installation into the inner wall of an anechoic chamber, but also in that the individual radio wave absorbent is of lightweight, and hence, the handling is easy. Therefore, for example, the radio wave absorbent-assembling members of the present invention are carried in the construction site of an anechoic chamber, radio wave absorbents are individually produced from these radio wave absorbent-assembling members, and a plurality of units of radio wave absorbents 211 are produced from the above radio wave absorbents. Then, the plurality of units of radio wave absorbents 211 are arranged in the inner wall of the anechoic chamber as shown in FIG. 23, and frame members 212 are joined with each other. Therefore, the workability at the construction of the anechoic chamber, from carrying in and assembling to installation, is extremely excellent. It is noted that the radio wave absorbent is not limited to the above two examples in which radio wave absorbents 101 and 141 are used as individual radio wave absorbents.

As the above-mentioned frame members 202 and 212, there can be mentioned (1) a non-combustible board which contains a conductive material therein; (2) a non-combustible board which has on the surface thereof a conductive layer containing a conductive material; and (3) a non-combustible board which contains a conductive material therein and has on the surface thereof a conductive layer containing a conductive material. Especially preferred is a non-combustible board obtained by a method in which non-combustible sheets made from a slurry which contains a hydrous inorganic compound and a conductive material are laminated using an inorganic adhesive into a honeycomb form, to thereby obtain a honeycomb structure, and non-combustible sheets are disposed on both surfaces of the obtained honeycomb structure, from the viewpoints of the radio wave absorption properties, the weight reduction, the non-combustibility, the mechanical strength and the heat dissipation properties.

The production of the above-mentioned non-combustible board having a honeycomb structure is performed as follows. First, a non-combustible sheet is made from a slurry which contains a hydrous inorganic compound and, if desired, a conductive material, the non-combustible sheet is coated with an inorganic adhesive in a line form at the predetermined interval in the lengthwise direction of the sheet while shifting the coating position of the inorganic adhesive in a line form by a half pitch between the adjacent non-combustible sheets, followed by lamination of a predetermined number of the non-combustible sheets. The resultant laminate is pressed so that the sheets are joined together at inorganic adhesive coating sites, to thereby obtain a sheet block. In this case, the coating width of the above inorganic adhesive corresponds to the length of the lamination surface of the cell of the honeycomb structure, and the cell size can be controlled by adjusting the width and the formation interval of the inorganic adhesive layer. Then, the above-obtained sheet block is cut out so that the thickness of a honeycomb structure becomes a desired value, and immersed in an inorganic impregnating agent, to thereby allow the cut-out sheet to expand. The inorganic impregnating agent is dried and set in a desired expansion state such that a desired cell can be formed, to form an inorganic impregnating agent layer, thereby obtaining a honeycomb structure. Then, the above-mentioned non-combustible sheets are arranged on both surfaces of the obtained honeycomb structure using an inorganic adhesive.

As the inorganic binder used, there can be mentioned, for example, an aqueous solution or an aqueous dispersion comprising an aluminum phosphate solution, a colloidal silica, a colloidal alumina or the like having mixed therewith a curing agent, a catalyst and the like. Further, as the inorganic impregnating agent, various types of inorganic adhesives can be used, and it is preferred that the same inorganic adhesive as that used for joining the non-combustible sheet is used.

The thickness of each of the above-mentioned frame members 202 and 212 can be adjusted in the range of from about 3 to 200 mm.

Further, as connecting members 203*a* and 203*b* used in the production of the above units of radio wave absorbents 201 and 211, there can be mentioned those which are formed into a sheet form using an inorganic adhesive, such as a fire-resistant fiber or a glass fiber. As the adhesive used, the above-mentioned inorganic adhesives can be mentioned.

Sixth embodiment

Figure 24:
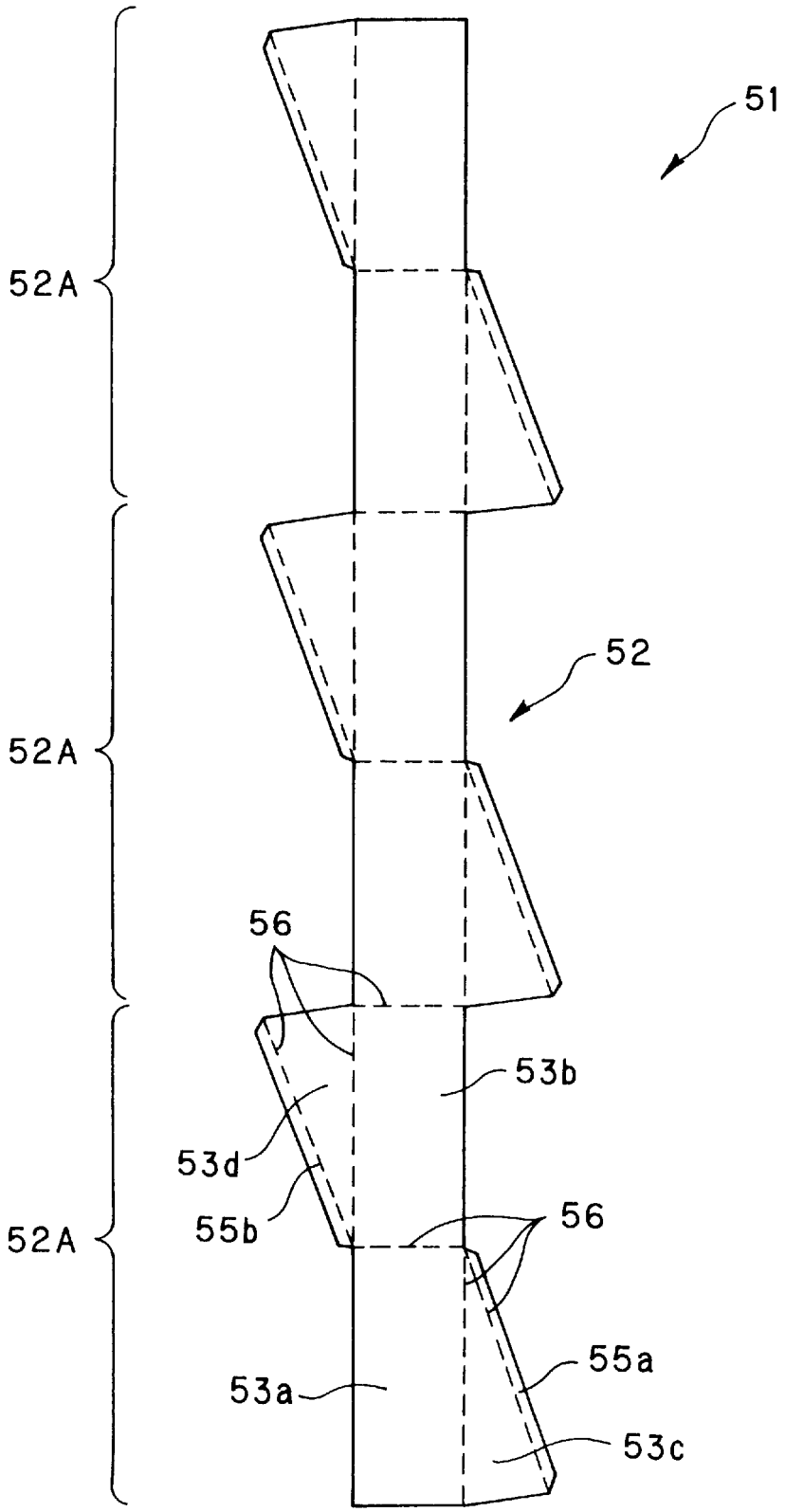
FIG. 24 is a plan view showing another embodiment of the radio wave absorbent-assembling member of the present invention.

FIG. 24 is a plan view showing another embodiment of the radio wave absorbent-assembling member of the present invention. In FIG. 24, radio wave absorbent-assembling member 51 comprises radio wave absorptive thin material 52 which is capable of assembling a structure in a desired form. In the example shown in this figure, thin material 52 comprises three units 52A which are connected, and is capable of assembling a structure which comprises a three wedge forms connected. Specifically, in thin material 52, single assembly unit 52A comprises oblique plane members 53*a* and 53*b* which constitute the oblique planes of the wedge form, side plane members 53*c* and 53*d* which constitute the side planes, and joining members 55*a* and 55*b* which are respectively provided in the end portions of side plane members 53*c* and 53*d*, and three assembly units 52A are connected. Further, each of assembly units 52A has concave portions 56 (indicated by chain lines) for folding at the respective boundaries between the above-mentioned members, and thin material 52 has concave portions 56 (indicated by chain lines) for folding at the respective boundaries between the above-mentioned units. With respect to thin material 52, the types of material and the thickness and the like can be selected similarly to those in the case of the above-mentioned thin material 2 of radio wave absorbent-assembling member 1. Therefore, an explanation about these is omitted here.

Figure 25A:
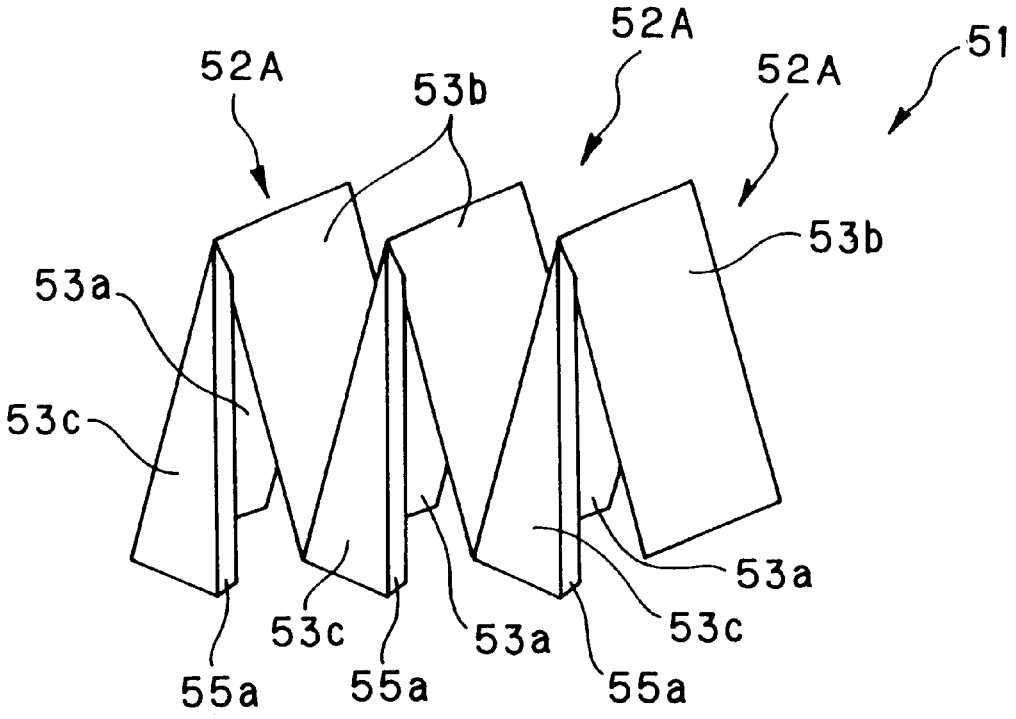
FIGS. 25A and 25B are explanatory views illustrating the method for producing a radio wave absorbent using the radio wave absorbent-assembling member shown in FIG. 24 and the radio wave absorbent of the present invention.
Figure 25B:
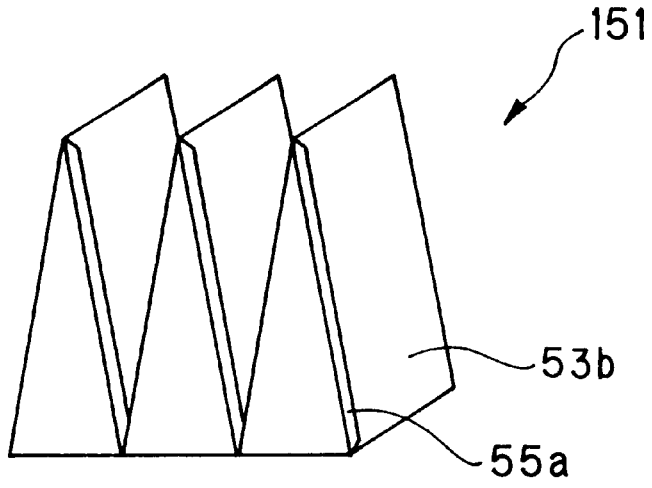

FIG. 25 are explanatory views illustrating the method for producing a radio wave absorbent using the radio wave absorbent-assembling member shown in FIG. 24 and the radio wave absorbent of the present invention. The method for producing a radio wave absorbent of the present invention comprises folding radio wave absorbent-assembling member 51 at concave portions 56 for folding in thin material 52 (see FIG. 25(A)), and respectively joining the end portions of oblique plane members 53*a* and 53*b* to the end portions of side plane members 53*d* and 53*c* by respectively bonding joining members 55*b* and 55*a* to the end portions of oblique plane members 53*a* and 53*b*, to thereby obtain radio wave absorbent 151 in the form of wedge of the present invention (see FIG. 25(B)). Thus obtained radio wave absorbent 151 in the form of wedge is a structure which comprises three wedge forms connected as shown in these figures. As the adhesive used in the assembly, the above-mentioned inorganic adhesives can be mentioned.

Further, in the present invention, by the above-mentioned method of the present invention, a plurality of the above radio wave absorbents 151 are connected to each other to form a single unit, and a frame member can be fixed for supporting on the periphery of the lower portion of the above unit.

Figure 26A:
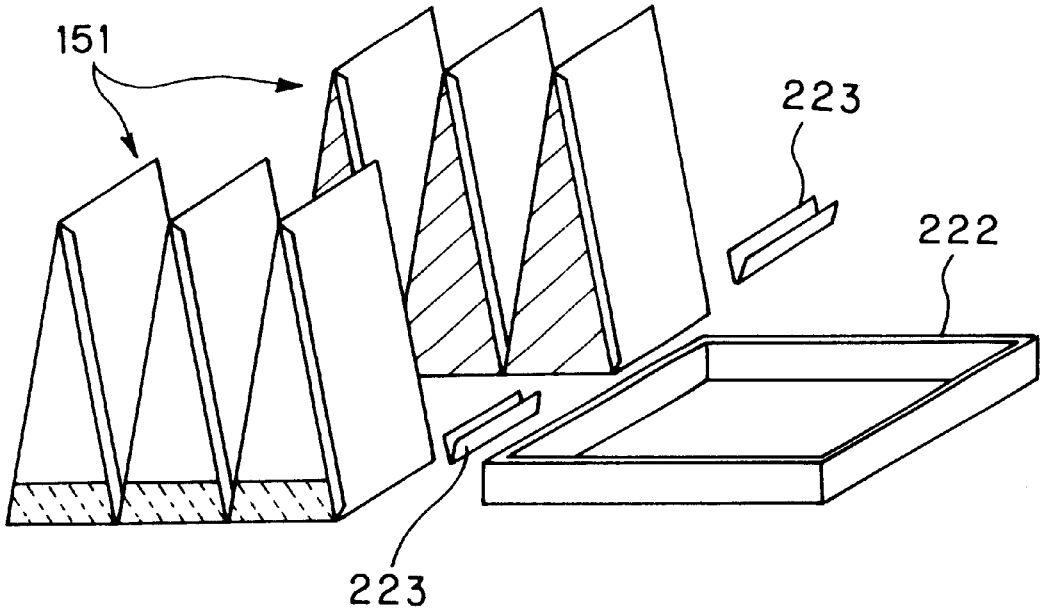
FIGS. 26A and 26B are explanatory views illustrating another examples of the method for producing a radio wave absorbent and the radio wave absorbent of the present invention.
Figure 26B:
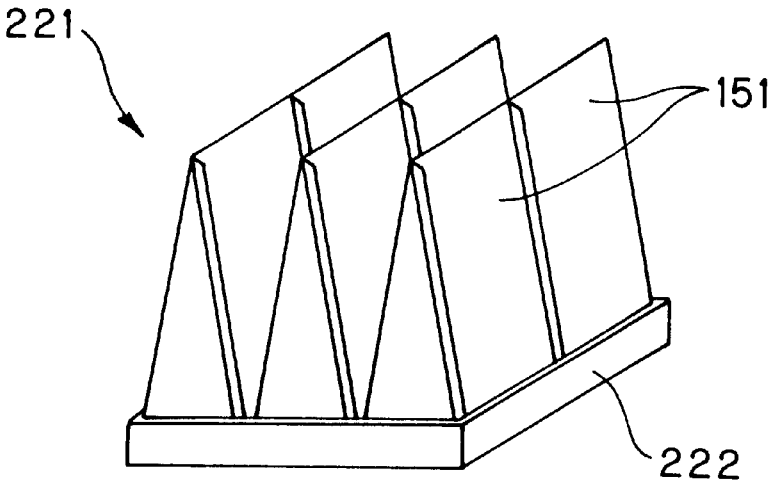

FIG. 26 are perspective views showing an example of the production of a radio wave absorbent as a unit by such a method. In FIG. 26, two radio wave absorbents 151 are connected to each other using an inorganic adhesive at the side planes (planes indicated by diagonal solid lines with respect to one side of radio wave absorbents 151) of the opposite radio wave absorbents 151, to thereby form a single unit. The unit is installed in frame member 222 in the corresponding form. Then, the base portions of the oblique planes of radio wave absorbents 151 and frame member 222 are connected to each other using four connecting members 223, and the base portions of the side planes of radio wave absorbents 151 (planes indicated by diagonal chain lines with respect to one side of radio wave absorbents 151) and frame member 222 are connected to each other using an inorganic adhesive (see FIG. 26(A)), to thereby obtain radio wave absorbent 221 as a single unit shown in FIG. 26(B).

Frame member 222 and connecting member 223 are respectively similar to frame member 202 or 212 and connecting member 203*a* or 203*b*. Therefore, an explanation about these is omitted here.

In addition, in this embodiment, the portion for folding of the radio wave absorbent-assembling member may have a reinforcing member and the tip portion of the individual radio wave absorbent may also have a reinforcing member, and joining members 55*a* and 55*b* can be in various forms mentioned above. Further, the above-mentioned pedestal plate may also be arranged on the bottom portion of radio wave absorbent 221.

Seventh embodiment

Figure 27:
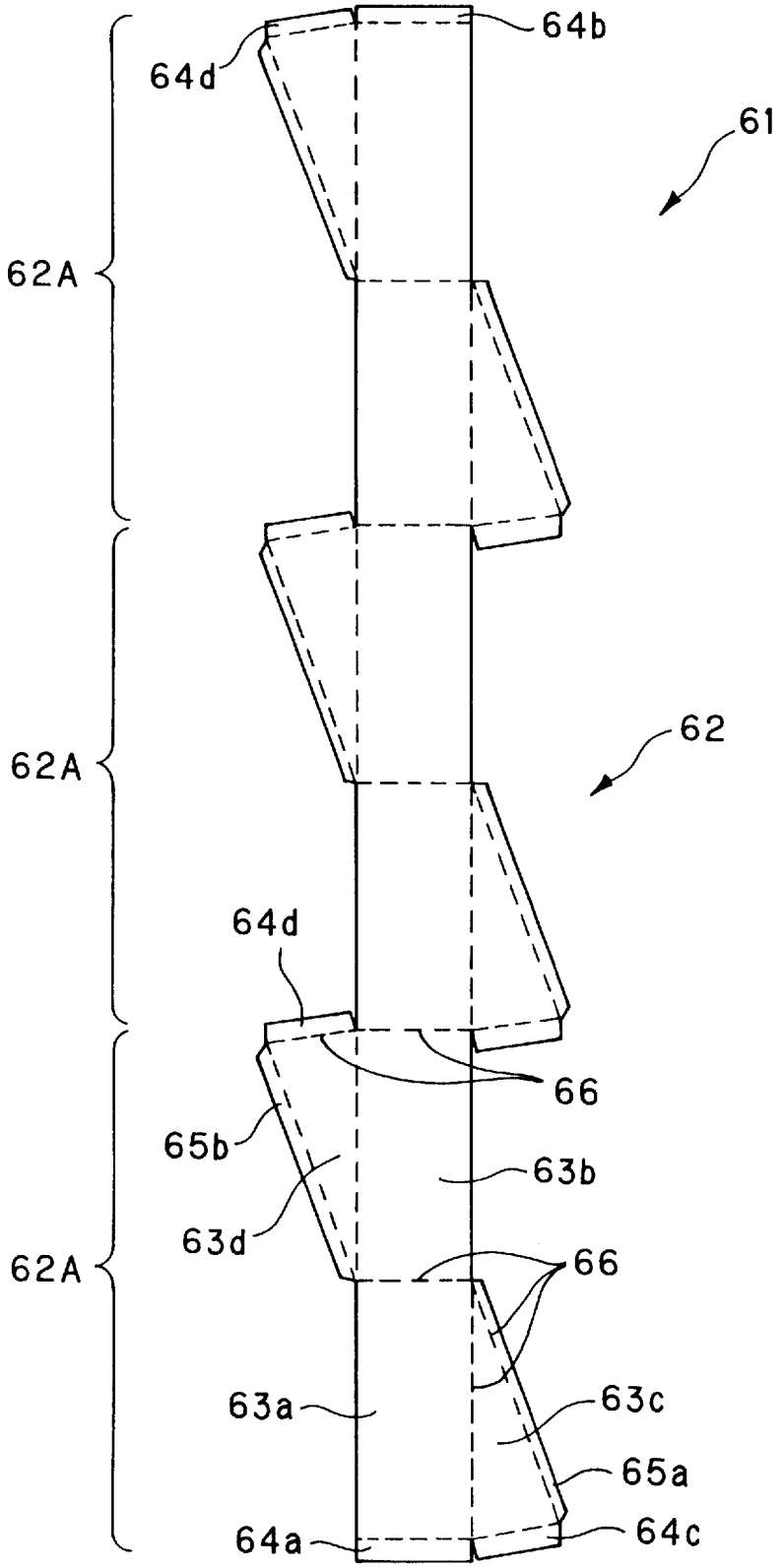
FIG. 27 is a plan view showing another embodiment of the radio wave absorbent-assembling member of the present invention.

FIG. 27 is a plan view showing another embodiment of the radio wave absorbent-assembling member of the present invention. In FIG. 27, radio wave absorbent-assembling member 61 comprises radio wave absorptive thin material 62 which is capable of assembling a structure in a desired form. In the example shown in this figure, thin material 62 comprises three units 62A which are connected, and is capable of assembling a structure which comprises a three wedge forms connected. Specifically, in thin material 62, single assembly unit 62A comprises oblique plane members 63*a* and 63*b* which constitute the oblique planes of the wedge form, side plane members 63*c* and 63*d* which constitute the side planes, joining members 65*a* and 65*b* which are respectively provided in the end portions of side plane members 63*c* and 63*d*, and fixing members 64*c* and 64*d* which are respectively provided in side plane members 63*c* and 63*d*, and three assembly units 62A are connected. The end portions of thin material 62 have fixing members 64*a* and 64*b*. Further, each of assembly units 62A has concave portions 66 (indicated by chain lines) for folding at the respective boundaries between the above-mentioned members, and thin material 62 has concave portions 66 (indicated by chain lines) for folding at the respective boundaries between the above-mentioned units. With respect to thin material 62, the types of material and the thickness and the like can be selected similarly to those in the case of the above-mentioned thin material 2 of radio wave absorbent-assembling member 1. Therefore, an explanation about these is omitted here.

Figure 28A:
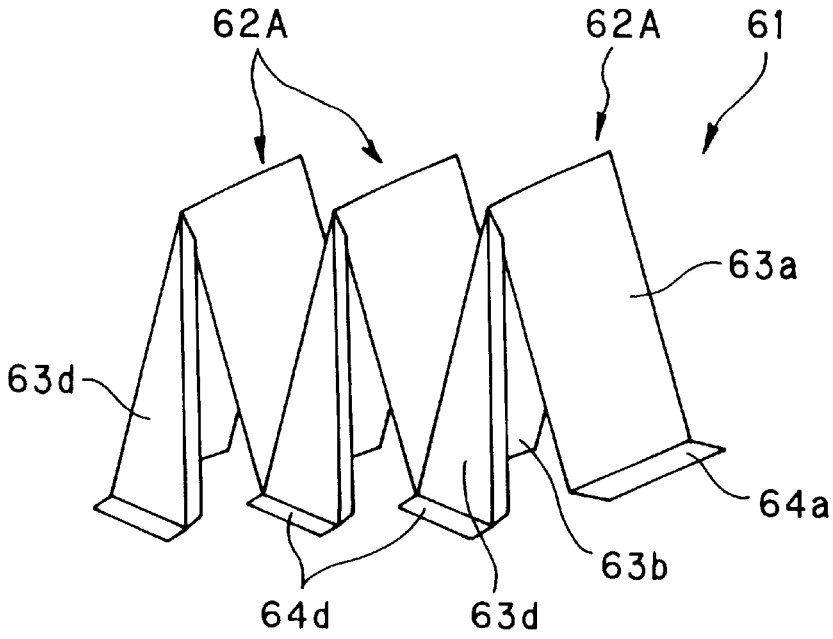
FIGS. 28A and 28B are explanatory views illustrating the method for producing a radio wave absorbent using the radio wave absorbent-assembling member shown in FIG. 27 and the radio wave absorbent of the present invention.
Figure 28B:
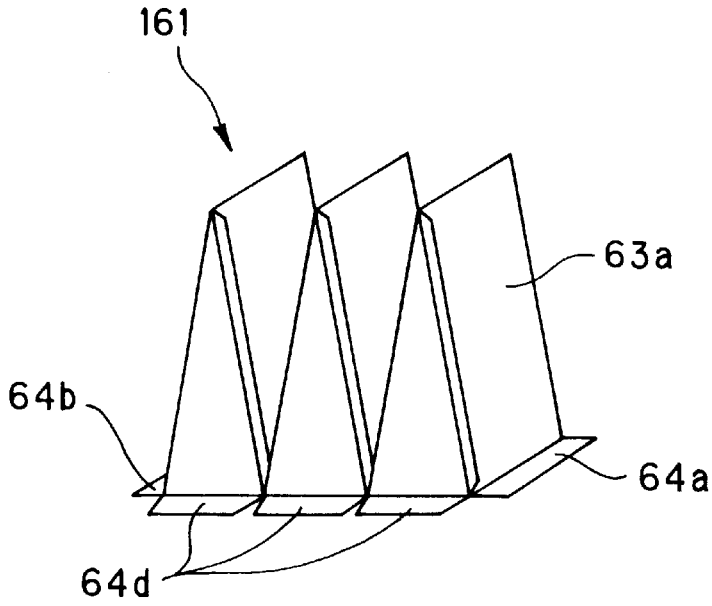

FIG. 28 are explanatory views illustrating the method for producing a radio wave absorbent using the radio wave absorbent-assembling member shown in FIG. 27 and the radio wave absorbent of the present invention. The method for producing a radio wave absorbent of the present invention comprises folding radio wave absorbent-assembling member 61 at concave portions 66 for folding in thin material 62 (see FIG. 28(A)), and respectively joining the end portions of oblique plane members 63*a* and 63*b* to the end portions of side plane members 63*d* and 63*c* by respectively bonding joining members 65*b* and 65*a* to the end portions of oblique plane members 63*a* and 63*b*, and folding outward fixing members 64*a*, 64*b*, 64*c* and 64*d* at concave portions 66, to thereby obtain radio wave absorbent 161 in the form of wedge of the present invention (see FIG. 28(B)). Thus obtained radio wave absorbent 161 in the form of wedge is a structure which comprises three wedge forms connected as shown in these figures. As the adhesive used in the assembly, the above-mentioned inorganic adhesives can be mentioned.

Further, in the present invention, by the above-mentioned method of the present invention, a plurality of the above radio wave absorbents 161 are connected to each other to form a single unit, and a frame member can be fixed for supporting on the periphery of the bottom portion of the above unit.

Figure 29A:
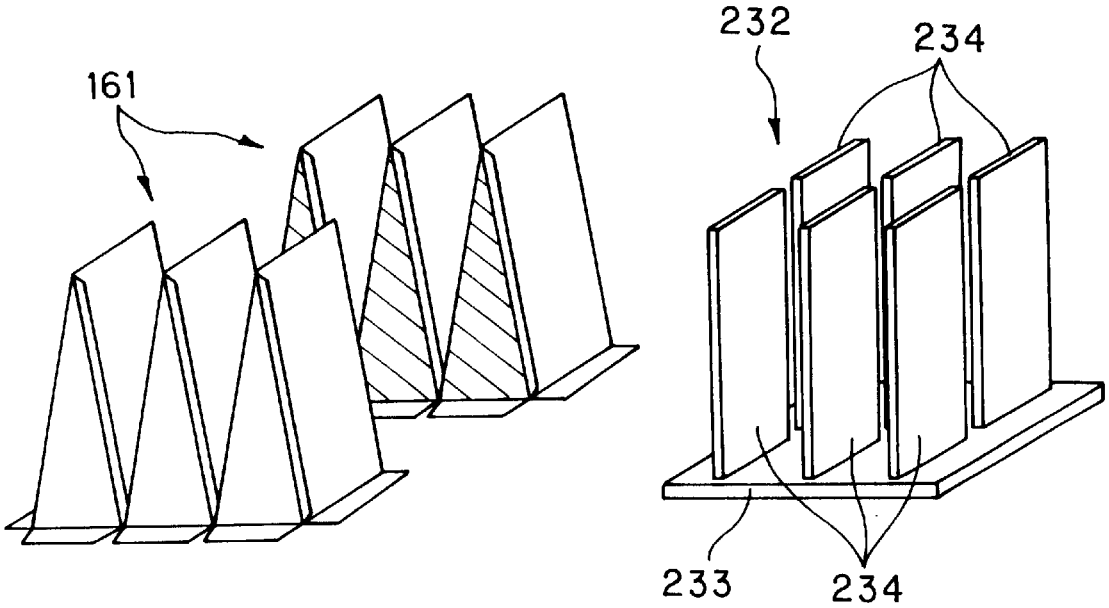
FIGS. 29A and 29B are explanatory views illustrating another examples of the method for producing a radio wave absorbent and the radio wave absorbent of the present invention.
Figure 29B:
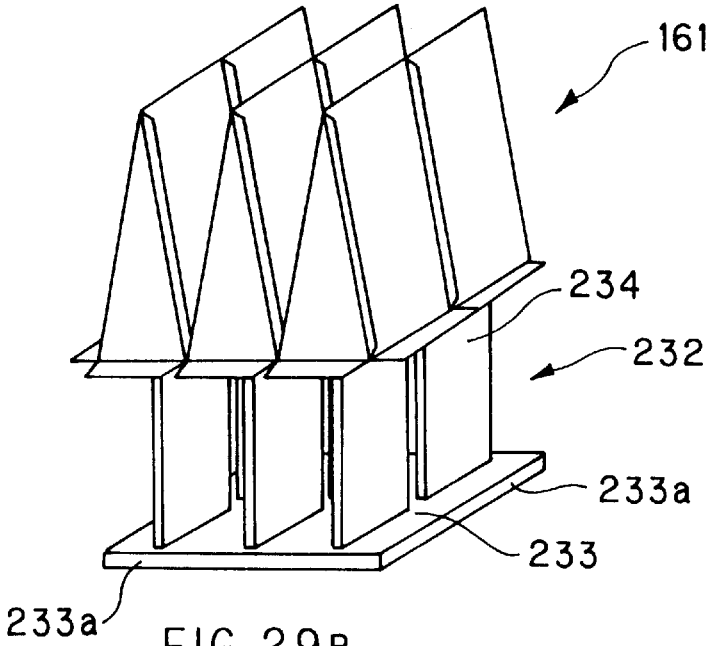
Figure 30:
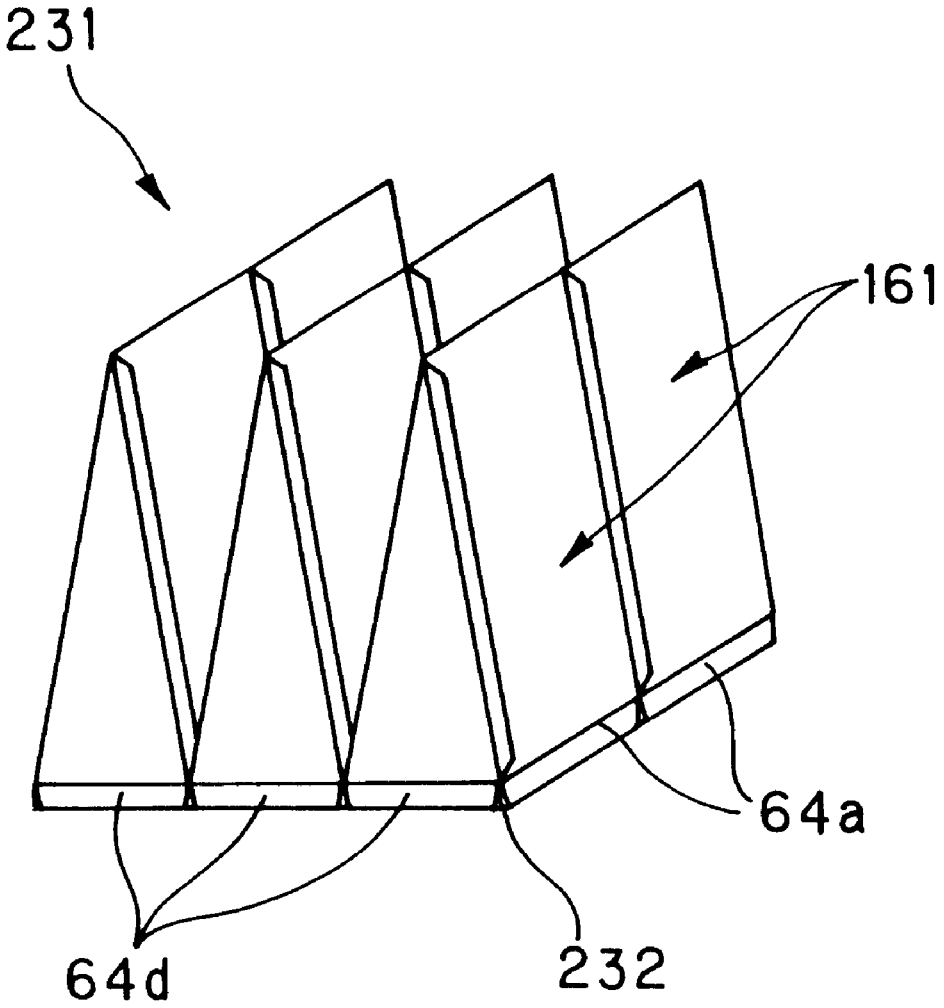
FIG. 30 is a perspective view showing a radio wave absorbent produced by the method for producing the radio wave absorbent of the present invention shown in FIGS. 29.

FIG. 29 are perspective views showing an example of the production of a radio wave absorbent as a unit by such a method. In FIG. 29, two radio wave absorbents 161 are connected to each other using an inorganic adhesive at the side planes (planes indicated by diagonal solid lines with respect to one side of radio wave absorbents 161) of the opposite radio wave absorbents 161, to thereby form a single unit. On the other hand, supporting material 232 comprising base plate 233 made in the form corresponding to the base plane of the obtained unit and six reinforcing plates 234 disposed on base plate 233 are provided (see FIG. 29(A)). Then, the unit comprising two radio wave absorbents 161 is installed on supporting material 232 so that reinforcing plates 234 are respectively inserted into the structures in the form of wedge (see FIG. 29(B)). Then, the fixing members 64*a*, 64*b*, 64*c* and 64*d* of radio wave absorbents 161 are fixed on side plane 233*a* of base plate 233 using an inorganic adhesive, to thereby obtain radio wave absorbent 231 as a single unit shown in FIG. 30.

Supporting material 232 can be produced from a laminate of a non-combustible paper, or a non-combustible board. As the non-combustible paper, there can be used one that is made from a slurry which contains a hydrous inorganic compound. In addition, as the non-combustible board, there can be used a non-combustible board having a honeycomb structure prepared using a non-combustible sheet made from a slurry which contains a hydrous inorganic compound in the same procedure as that described in connection with the above frame members 202 and 212.

Further, in this embodiment, the portion for folding of the radio wave absorbent-assembling member may have a reinforcing member and the tip portion of the individual radio wave absorbent may also have a reinforcing member, and joining members 65*a* and 65*b* can be in various forms mentioned above.

Hereinbelow, the present invention will now be further illustrated in more detail with reference to the following Examples and Comparative Examples.

Example 1

First, a slurry for a non-combustible paper having the composition described below was prepared using a Henschel mixer.

Composition of Slurry for Non-combustible Paper

Sepiolite (Aidplus, manufactured and sold by Mizusawa Chemical Industries, Co., Ltd.): 60 Parts by weight Glass fiber (6 mm product, manufactured and sold by Nitto Boseki Co., Ltd.): 7 Parts by weight Graphite (Blue P, manufactured and sold by Nippon Kokuen Co., Ltd.) 30 Parts by weight Organic binder 3 Parts by weight Next, using the above-prepared slurry, a non-combustible paper (thickness: 0.7 mm) as a thin material containing a conductive material was made, and a radio wave absorbent-assembling member in the form shown in FIG. 1 was prepared. The content of the conductive material in the prepared radio wave absorbent-assembling member was 78 $g/m^2$. The above radio wave absorbent-assembling member had concave portions for folding (depth: 0.08 mm).

Then, using the above radio wave absorbent-assembling member and an inorganic adhesive (a mixture of potassium silicate and diantimony pentaoxide), a radio wave absorbent was prepared as follows. The radio wave absorbent-assembling member was folded at the concave portions for folding as shown in FIG. 2, and the end portions of the side planes were joined together to form a base plane, to thereby prepare a radio wave absorbent in the form of quadrangular pyramid (height: 900 mm; length of the base: 200 mm). The same nine radio wave absorbents were prepared.

With respect to the above-prepared radio wave absorbents, the non-combustibility was measured by the method described below. The results are shown in Table 1.

Non-combustibility Test

A test was performed in accordance with the method for a non-combustible material prescribed in Notification No. 1828 of the Ministry of Construction. The radio wave absorbents were laminated using an inorganic adhesive (FJ294, manufactured and sold by Tokiwa Electric Co., Ltd.), to thereby prepare a test specimen having a size of 40 mm×40 mm×50 mm. The test specimen was heated in a furnace at 750±10° C. for 20 min, and the increase in the temperature of the specimen by heating was measured. When the increase in the temperature of the specimen by heating is less than 50° C., the non-combustibility of this specimen is acceptable.

Figure 31:
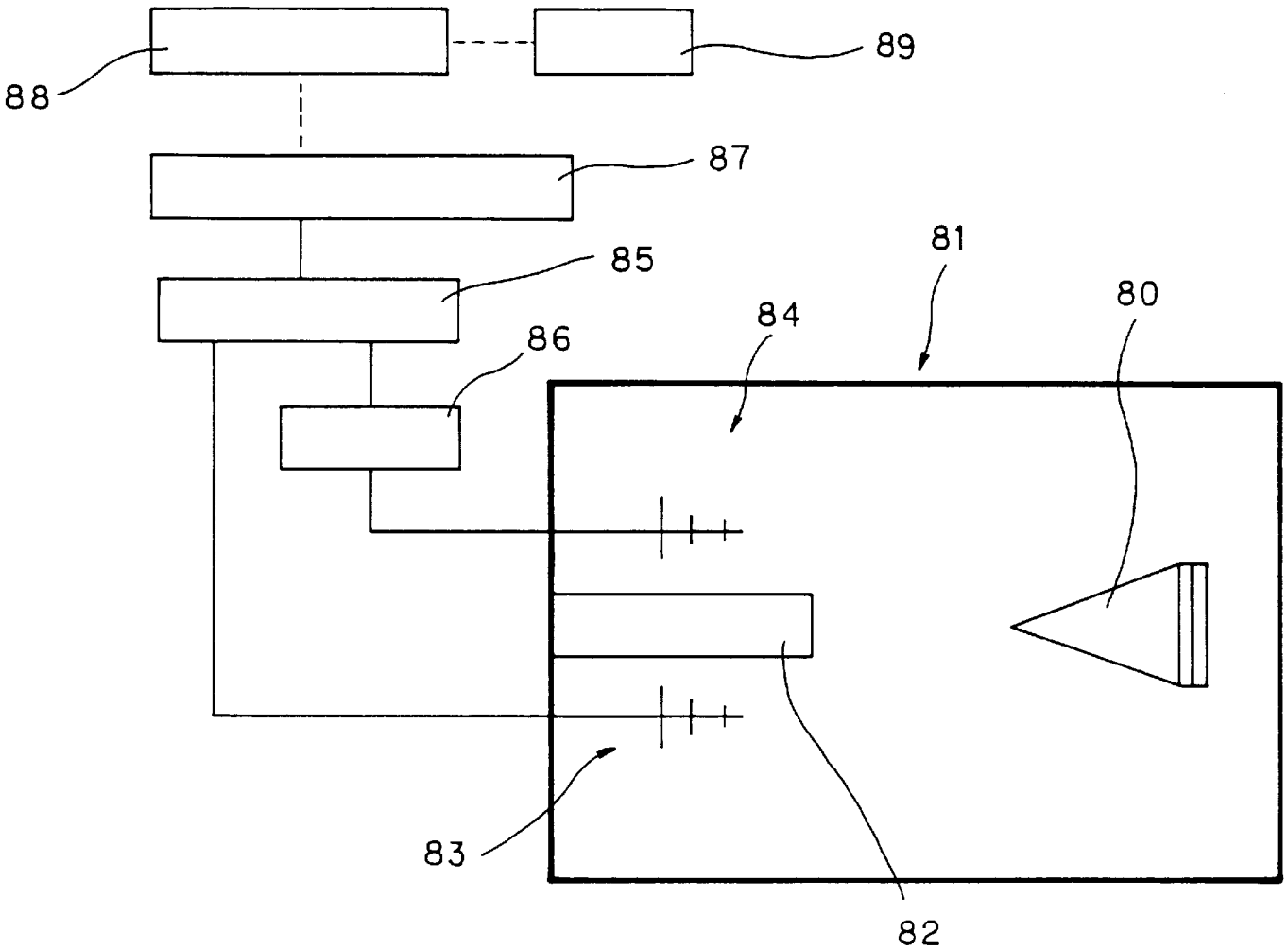
FIG. 31 is a block diagram showing a measurement system for measurements of radio wave absorbing ability at 1 GHz with respect to the radio wave absorbents in the examples.

In addition, ferrite IB-011 (thickness: 6.9 mm) (manufactured and sold by TDK Corporation) having a shield panel on the back surface thereof was fitted on the base plane of the above radio wave absorbent, and a radio wave absorbing ability at 1 GHz was measured. Specifically, as shown in the block diagram of the measurement system in FIG. 31, in anechoic chamber 81, radio wave absorbent 80 was subjected to radio wave irradiation, and a reflection wave level was measured. In anechoic chamber 81, transmitting antenna 83 and receiving antenna 84 are arranged with screen 82 between, and to transmitting antenna 83 is connected S-parameter 85, and receiving antenna 84 is connected through RF amplifier 86 to the above S-parameter 85. Further, S-parameter 85 is connected through network analyzer 87 to measurement controller 88, and to this measurement controller 88 is connected printer 89. The reflectivity (dB) of a radio wave absorbent was calculated using, as a reference, the reflection level of a metal plate having the same size (600 mm×600 mm) as that of the base plane of the unit comprising nine radio wave absorbents by the following formula, and the results are shown in Table 1.

Reflectivity (dB)=Reflection level (dB) of radio wave absorbent−Reflection level (dB) of metal plate Example 2

First, a slurry for a non-combustible paper having the composition described below was prepared using a Henschel mixer.

Composition of Slurry for Non-combustible Paper

Sepiolite (Aidplus, manufactured and sold by Mizusawa Chemical Industries, Co., Ltd.): 80 Parts by weight Glass fiber (6 mm product, manufactured and sold by Nitto Boseki Co., Ltd.): 15 Parts by weight Organic binder 5 Parts by weight Next, using the above-prepared slurry, a non-combustible paper (thickness: 0.7 mm) was made.

Then, a conductive coating liquid having the composition described below was prepared using a Henschel mixer.

Composition of Conductive Coating Liquid

Graphite (Blue P, manufactured and sold by Nippon Kokuen Co., Ltd.) 20 Parts by weight Inorganic coating agent (FJ803, manufactured and sold by Tokiwa Electric Co., Ltd.) 80 Parts by weight Subsequently, one surface of the above non-combustible paper was coated with the above-prepared conductive coating liquid by spraying, followed by drying, to thereby form a radio absorptive thin material. Then, a radio wave absorbent-assembling member in the form shown in FIG. 1 was prepared. The content of the conductive material in the prepared radio wave absorbent-assembling member was 45 g/m$^2$. The above radio wave absorbent-assembling member had concave portions for folding (depth: 0.08 mm).

Then, using the above radio wave absorbent-assembling member, nine radio wave absorbents in the form of quadrangular pyramid (height: 900 mm; length of the base: 200 mm) in which the conductive coating liquid coated surface was arranged as the surface of the radio wave absorbent were prepared in the same manner as in Example 1.

With respect to the above-prepared radio wave absorbents, the non-combustibility and the radio wave absorbing ability at 1 GHz were measured in the same manner as in Example 1, and the results are shown in Table 1.

Example 3

A non-combustible paper (thickness: 0.7 mm) was made in the same manner as in Example 2.

Next, a conductive coating liquid having the composition described below was prepared using a Henschel mixer.

Composition of Conductive Coating Liquid

Carbon black (EC, manufactured and sold by Kechen Black Co., Ltd.) 10 Parts by weight Inorganic coating agent (FJ803, manufactured and sold by Tokiwa Electric Co., Ltd.) 90 Parts by weight Then, one surface of the above non-combustible paper was coated with the above-prepared conductive coating liquid using a roller, followed by drying, to thereby form a radio absorptive thin material. Then, a radio wave absorbent-assembling member in the form shown in FIG. 1 was prepared. The content of the conductive material in the prepared radio wave absorbent-assembling member was 7 g/m$^2$. The above radio wave absorbent-assembling member had concave portions for folding (depth: 0.08 mm).

Subsequently, using the above radio wave absorbent-assembling member, nine radio wave absorbents in the form of quadrangular pyramid (height: 900 mm; length of the base: 200 mm) in which the conductive coating liquid coated surface was arranged as the surface of the radio wave absorbent were prepared in the same manner as in Example 1.

With respect to the above-prepared radio wave absorbents, the non-combustibility and the radio wave absorbing ability at 1 GHz were measured in the same manner as in Example 1, and the results are shown in Table 1.

Example 4

A non-combustible paper (thickness: 0.7 mm) was made in the same manner as in Example 2.

Next, a conductive coating liquid was prepared using a Henschel mixer in the same manner as in Example 2.

Then, one surface of the above non-combustible paper was coated with the above-prepared conductive coating liquid by spraying, followed by drying, to thereby form a radio absorptive thin material. Then, a radio wave absorbent-assembling member in the form shown in FIG. 24 was prepared. The content of the conductive material in the prepared radio wave absorbent-assembling member was 48 g/m$^2$. The above radio wave absorbent-assembling member had concave portions for folding (depth: 0.08 mm).

Then, using the above radio wave absorbent-assembling member and an inorganic adhesive (a mixture of potassium silicate and diantimony pentaoxide), a radio wave absorbent in which the conductive coating liquid coated surface was arranged as the surface of the radio wave absorbent and three wedge forms were connected (with respect to one wedge form, the height was 900 mm, the tip width was 300 mm, and the base plane was 200 mm×300 mm) was prepared. The same two radio wave absorbents were prepared.

With respect to the above-prepared radio wave absorbents, the non-combustibility and the radio wave absorbing ability at 1 GHz were measured in the same manner as in Example 1, and the results are shown in Table 1.

Example 5

A non-combustible paper (thickness: 0.7 mm) was made in the same manner as in Example 2.

Next, a conductive coating liquid was prepared using a Henschel mixer in the same manner as in Example 2.

Then, one surface of the above non-combustible paper was coated with the above-prepared conductive coating liquid by spraying, followed by drying, to thereby form a radio absorptive thin material. Then, a radio wave absorbent-assembling member in the form shown in FIG. 24 was prepared. The content of the conductive material in the prepared radio wave absorbent-assembling member was adjusted so that, with respect to each wedge form of the below-mentioned radio wave absorbent comprising three wedge forms connected, the conductive material contents of the ⅓ height portions from the side of the radio wave irradiation source (tip side) became 15 g/m$^2$, 30 g/m$^2$ and 45 g/m$^2$, respectively. The above radio wave absorbent-assembling member had concave portions for folding (depth: 0.08 mm).

Then, using the above radio wave absorbent-assembling member and an inorganic adhesive (a mixture of potassium silicate and diantimony pentaoxide), two radio wave absorbents were prepared in the same manner as in Example 4, in which the conductive coating liquid coated surface was arranged as the surface of the radio wave absorbent and three wedge forms were connected (with respect to one wedge form, the height was 900 mm, the tip width was 300 mm, and the base plane was 200 mm×300 mm) was prepared.

With respect to each of the above-prepared radio wave absorbents, the non-combustibility and the radio wave absorbing ability at 1 GHz were measured in the same manner as in Example 1, and the results are shown in Table 1.

Comparative Example 1

A non-combustible paper (thickness: 0.7 mm) was made in the same manner as in Example 2.

Next, a conductive coating liquid was prepared using a Henschel mixer in the same manner as in Example 2.

Then, one surface of the above non-combustible paper was coated with the above-prepared conductive coating liquid by spraying, followed by drying, to thereby form a radio absorptive thin material. Then, a radio wave absorbent-assembling member in the form shown in FIG. 1 was prepared. The content of the conductive material in the prepared radio wave absorbent-assembling member was 3 g/m$^2$. The above radio wave absorbent-assembling member had concave portions for folding (depth: 0.08 mm).

Then, using the above radio wave absorbent-assembling member, nine radio wave absorbents in the form of quadrangular pyramid (height: 900 mm; length of the base: 200 mm) in which the conductive coating liquid coated surface was arranged as the surface of the radio wave absorbent were prepared in the same manner as in Example 1.

With respect to the above-prepared radio wave absorbents, the non-combustibility and the radio wave absorbing ability at 1 GHz were measured in the same manner as in Example 1, and the results are shown in Table 1.

Comparative Example 2

A non-combustible paper (thickness: 0.7 mm) was made in the same manner as in Example 2.

Next, a conductive coating liquid was prepared using a Henschel mixer in the same manner as in Example 2.

Then, one surface of the above non-combustible paper was coated with the above-prepared conductive coating liquid by spraying, followed by drying, to thereby form a radio absorptive thin material. Then, a radio wave absorbent-assembling member in the form shown in FIG. 1 was prepared. The content of the conductive material in the prepared radio wave absorbent-assembling member was 82 g/m$^2$. The above radio wave absorbent-assembling member had concave portions for folding (depth: 0.08 mm).

Then, using the above radio wave absorbent-assembling member, nine radio wave absorbents in the form of quadrangular pyramid (height: 900 mm; length of the base: 200 mm) in which the conductive coating liquid coated surface was arranged as the surface of the radio wave absorbent were prepared in the same manner as in Example 1.

With respect to each of the above-prepared radio wave absorbents, the non-combustibility and the radio wave absorbing ability at 1 GHz were measured in the same manner as in Example 1, and the results are shown in Table 1.

TABLE 1

| Radio Wave Absorbent | Non-Combustibility | Reflectivity (dB) |
|---|---|---|
| Example 1 | Good (797° C.) | −32 |
| Example 2 | Good (778° C.) | −28 |
| Example 3 | Good (765° C.) | −21 |
| Example 4 | Good (778° C.) | −24 |
| Example 5 | Good (770° C.) | −30 |
| Comparative Example 1 | Good (763° C.) | −12 |
| Comparative Example 2 | Poor (812° C.) | −34 |

*Note: The figures given in parentheses "( )" at the column of "NON-COMBUSTIBILITY" indicates temperature values of the heated test specimens.

As shown in Table 1, it is confirmed that all of the radio wave absorbents prepared in Examples 1 to 5 are of light-weight and have excellent non-combustibility and excellent radio wave absorbing ability.

By contrast, the radio wave absorbing ability of the radio wave absorbent prepared in Comparative Example 1 is unsatisfactory. The radio wave absorbent prepared in Comparative Example 2 has excellent radio wave absorbing ability; however, this radio wave absorbent has a poor non-combustibility, as compared with the radio wave absorbents prepared in Examples.

What is claimed is:

1. A radio wave absorbent-assembling member comprising a radio wave absorptive thin material capable of being folded into a stereo-structure in a desired form along predetermined folding lines, wherein said thin material contains a conductive material therein and/or has on the surface thereof a conductive layer containing a conductive material, the thin material has a thickness of not greater than 4 mm, the folding lines being lines along which a concavity is present, the folding lines and the edges of the radio wave absorbent-assembling member defining plane members including side plane members and/or oblique plane members forming side planes and/or oblique planes of the stereo-structure and one or more joining members along an end portion of a plane member to overlap an end portion of another plane member and bondable thereto by an adhesive, the radio wave absorbent-assembling member being non-combustible.

2. The radio wave absorbent-assembling member according to claim 1, wherein said thin material contains a conductive material in the range of from 5 to 80 g/m$^2$.

3. The radio wave absorbent-assembling member according to claim 1, wherein said thin material is a noncombustible paper made from a slurry which contains a hydrous inorganic compound.

4. The radio wave absorbent-assembling member according to claim 1, wherein said conductive material comprises at least one substance selected from the group consisting of carbon black and graphite.

5. The radio wave absorbent-assembling member according to claim 1, which is capable of being assembled as a plurality of structures which are connected to each other.

6. The radio wave absorbent-assembling member according to claim 1, wherein the plane members include base plane members inwardly foldable to form the base plane of the stereo structure.

7. The radio wave absorbent-assembling member according to claim 1, wherein the plane members include outwardly foldable members along the base edges of the stereo structure.

8. The radio wave absorbent-assembling member according to claim 1, wherein the desired structure is a connected series of wedges, the oblique planes of which are connected.

9. The radio wave absorbent-assembling member according to claim 1, wherein the stereo structure is a quadrangular pyramid.

10. The radio wave absorbent-assembling member according to claim 1, wherein the stereo structure is a wedge.

11. A radio wave absorbent formed using a radio wave absorbent-assembling member, which is a structure formed by folding said radio wave absorbent-assembling member which comprises a radio wave absorptive thin material capable of being folded into a stereo-structure in a desired hollow form along predetermined folding lines and joined together by an adhesive along the end portions of the folded radio wave absorbent-assembling member, wherein said thin material contains a conductive material therein and/or has on the surface thereof a conductive layer containing a conductive material, the thin material has a thickness of not greater than 4 mm, the folding lines being lines along which a concavity is present, the folding lines and the edges of the radio wave absorbent-assembling member defining plane members including side plane members and/or oblique plane members forming planes of the stereo-structure and one or more joining members positioned along an end portion of a plane member to overlap an end portion of another plane member and bondable thereto by an adhesive, the radio wave absorbent-assembling member being non-combustible.

12. The radio wave absorbent according to claim 11, wherein said structure is in the form of any one of wedge and quadrangular pyramid.

13. The radio wave absorbent according to claim 11, which comprises a plurality of structures which are connected to each other and a frame member fixed on the periphery of the lower portion of said plurality of structures.

14. The radio wave absorbent according to claim 11, which comprises a plurality of structures which are connected to each other and a supporting material fixed on the periphery of the bottom portion of said plurality of structures.

15. The radio wave absorbent according to claim 11, wherein said thin material contains a conductive material in the range of from 5 to 80 $g/m^2$.

16. The radio wave absorbent according to claim 11, wherein said thin material is a non-combustible paper made from a slurry which contains a hydrous inorganic compound.

17. The radio wave absorbent according to claim 11, wherein said conductive material comprises at least one substance selected from the group consisting of carbon black and graphite.

18. A method for producing a radio wave absorbent, which comprises:

processing a thin material into a form which is capable of being folded into a stereo-structure in a desired hollow form along predetermined folding lines, wherein said thin material contains a conductive material therein and/or has on the surface thereof a conductive layer containing a conductive material, the thin material has a thickness of not greater than 4 mm, the folding lines being lines along which a concavity is present, the folding lines and the edges of the radio wave absorbent-assembling member defining plane members including side plane members and/or oblique plane members forming the planes of the stereo-structure and one or more joining members positioned along an end portion of a plane member to overlap an end portion of another plane member and bondable thereto by an adhesive, the radio wave absorbent-assembling member being non-combustible, folding said radio wave absorbent-assembly member and joining together the end portions of the folded radio wave absorbent-assembling member by applying an adhesive to the joining members and adhering the joining members to the overlapped end portion of the plane member.

19. The method for producing a radio wave absorbent according to claim 18, wherein said radio wave absorbent is in the form of any one of wedge, quadrangular pyramid and triangular prism.

20. The method for producing a radio wave absorbent according to claim 18, which further comprises: preliminarily forming a concave portion for folding in said thin material, wherein said thin material is folded at said concave portion.

21. The method for producing a radio wave absorbent according to claim 18, which further comprises: connecting a plurality of said radio wave absorbents to each other, to thereby form a single unit; and fixing a frame member for supporting on the periphery of the lower portion of said unit.

22. The method for producing a radio wave absorbent according to claim 21, wherein said frame member is a noncombustible board which contains a conductive material therein and/or has on the surface thereof a conductive layer containing a conductive material.

23. The method for producing a radio wave absorbent according to claim 22, wherein said non-combustible board is obtained by a method in which non-combustible sheets made from a slurry which contains a hydrous inorganic compound are laminated using an inorganic adhesive into a honeycomb form, to thereby obtain a honeycomb structure, and non-combustible sheets are disposed on both the surfaces of the obtained honeycomb structure.

24. The method for producing a radio wave absorbent according to claim 18, which further comprises: connecting a plurality of said radio wave absorbents to each other, to thereby form a single unit: and fixing a supporting material for supporting on the periphery of the bottom portion of said unit.

25. The method for producing a radio wave absorbent according to claim 24, wherein said supporting material is any one of a laminate of a non-combustible paper and a noncombustible board.

26. The method for producing a radio wave absorbent according to claim 25, wherein said laminate is a non-combustible paper is a non-combustible paper made from a slurry which contains a hydrous inorganic compound.

27. The method for producing a radio wave absorbent according to claim 25, wherein said laminate is a non-combustible board which is obtained by a method in which non-combustible sheets made from a slurry which contains a hydrous inorganic compound are laminated using an inorganic adhesive into a honeycomb form, to thereby obtain a honeycomb structure, and non-combustible sheets are disposed on both the surfaces of the obtained honeycomb structure.

* * * * *